US007410237B2

(12) United States Patent
Yamada et al.

(10) Patent No.: US 7,410,237 B2
(45) Date of Patent: Aug. 12, 2008

(54) IMAGE RECORDING APPARATUS WITH MAINTENANCE UNIT

(75) Inventors: Takahisa Yamada, Hachioji (JP); Masanobu Shimizu, Hachioji (JP); Takashi Matsuyama, Hachioji (JP); Motoharu Miki, Hachioji (JP)

(73) Assignee: Olympus Corporation, Tokyo (JP)

( * ) Notice: Subject to any disclaimer, the term of this patent is extended or adjusted under 35 U.S.C. 154(b) by 243 days.

(21) Appl. No.: 10/963,876

(22) Filed: Oct. 12, 2004

(65) Prior Publication Data

US 2005/0078144 A1 Apr. 14, 2005

(30) Foreign Application Priority Data

Oct. 14, 2003 (JP) ..... 2003-353312

(51) Int. Cl.
*B41J 2/165* (2006.01)

(52) U.S. Cl. ..... 347/30

(58) Field of Classification Search ..... 347/32–34, 347/29–30

See application file for complete search history.

(56) References Cited

U.S. PATENT DOCUMENTS 5,701,146 A * 12/1997 Akiyama et al. ..... 347/26
6,257,700 B1 * 7/2001 Aihara et al. ..... 347/44
6,364,449 B1 * 4/2002 Takahashi et al. ..... 347/30
6,565,186 B1 * 5/2003 Hattori et al. ..... 347/24
7,033,005 B2 * 4/2006 Nakamura ..... 347/85
7,083,253 B2 * 8/2006 Kimura et al. ..... 347/29

FOREIGN PATENT DOCUMENTS

EP 872346 A1 * 10/1998
JP 4-70350 3/1992
JP 5-201028 A 8/1993

* cited by examiner

*Primary Examiner*—Matthew Luu
*Assistant Examiner*—Lisa M Solomon
(74) *Attorney, Agent, or Firm*—Frishauf, Holtz, Goodman & Chick, P.C.

(57) ABSTRACT

An image recording apparatus of the present invention comprises an inkjet head which includes a nozzle plate where a plurality of nozzles that shoot ink are arranged in a column and an ink chamber which retains ink and is connected to the plurality of nozzles, at least one maintenance suction section which has a suction area larger than the nozzles, a suction section driving mechanism which causes the suction area to face the nozzles and moves the suction section relatively in the nozzle arrangement direction, and a positive pressure applying section which applies a positive pressure to the ink chamber. The maintenance suction section sucks in ink near the nozzles as moving in the nozzle arrangement direction, while the positive pressure is being applied to the ink chamber.

22 Claims, 18 Drawing Sheets

IMAGE RECORDING APPARATUS WITH MAINTENANCE UNIT

CROSS-REFERENCE TO RELATED APPLICATIONS

This application is based upon and claims the benefit of priority from prior Japanese Patent Application No. 2003-353312, filed Oct. 14, 2003, the entire contents of which are incorporated herein by reference.

BACKGROUND OF THE INVENTION

1. Field of the Invention

This invention relates to an image recording apparatus with a maintenance unit, and more particularly to an image recording apparatus with suction means for sucking in ink on the nozzle plate of the inkjet head.

2. Description of the Related Art

Inkjet image recording apparatuses have been widely used. This type of image recording apparatus has an ink head which includes an ink supply source, an ink chamber, and a plurality of nozzles serving as ink discharge outlets. The image recording apparatus shoots ink in the ink chamber from the individual nozzles, thereby recording an image.

The nozzles are arranged in a column on the nozzle plate. The nozzle plate has a water-shedding finish, thereby preventing the adhesion of ink. Even when a water-shedding finish has been given, the adhesion of ink cannot be prevented completely, which may permit ink to collect on the nozzle plate.

Therefore, to maintain the stable ink jet characteristic, the image recording apparatus has to remove the unnecessary ink on the nozzle plate. For this reason, the image recording apparatus has a maintenance unit for removing the unnecessary ink adhering to the nozzle plate. Such an image recording apparatus has been disclosed in, for example, Jpn. Pat. Appln. KOKAI Publication No. 5-201028.

In this publication, a maintenance unit 1000 as shown in FIG. 23 has been disclosed for a conventional recording apparatus. The image recording apparatus has a head body 1011 in which a plurality of nozzles 1013 are arranged in a column. On the nozzle forming face of the head body 1011, a water-repellent thin film 1014 is provided.

The maintenance unit 1000 includes a vacuum nozzle 1020, a positioning section 1023, an ink trap section 1026, and a vacuum pump 1027. One end of the vacuum nozzle 1020 is supported by the positioning section 1023 which is capable of moving in the direction in which the nozzles 1013 of the ink jet head are arranged. The other end of the vacuum nozzle 1020 is connected to the vacuum pump 1027 via the ink trap section 1026.

The maintenance unit 1000 causes the positioning section 1023 to scan along the arrangement direction of the nozzles 1013, thereby causing the vacuum nozzle 1020 to face the nozzles squarely one after another. At the same time, the maintenance unit 1000 causes the vacuum pump 1027 to operate, thereby making the pressure of one end of the vacuum nozzle 1020 negative. As a result, the maintenance unit 1000 causes the vacuum nozzle 1020 to suck in the unnecessary ink inside and outside each of the nozzles 1013 one after another.

Generally, in the image recording apparatus, a negative pressure is always applied to the ink chamber 1012 as shown in FIG. 24, except when ink is discharged. In FIG. 24, ink is indicated by reference symbol i. With the negative pressure, the ink in the nozzle 1013 forms a concave meniscus in the nozzle 1013.

The negative pressure is generally set so as to form a meniscus in a specific position in the nozzle. More specifically, the negative pressure is so set that the position where the surface tension of the meniscus balances with the negative pressure comes to the specific position in the nozzle. Since the meniscus is formed by the negative pressure, it is not desirable that ink should be sucked out of the nozzle carelessly.

However, when suction is applied under negative pressure, the ink i in the nozzle 1013 and ink chamber 1012 is sucked into the vacuum nozzle 1020 by suction exceeding the negative pressure in the ink chamber 1012, as shown in FIG. 25. Specifically, the maintenance unit 1000 sucks in ink in such a manner that it draws out ink forcibly from the inner part of the nozzle 1013. As a result, the fluid level of the ink i retreats from the nozzle 1013 into the ink chamber 1012. As described above, since the negative pressure in the ink chamber is set so as to form a meniscus in the nozzle, the fluid level of ink in the ink chamber 1012 moves again so as to go back into the nozzle 1013, even during suction by the vacuum nozzle 1020. When ink is sucked in under negative pressure as described above, the fluid level of ink moves unstably between the nozzle 1013 and the interior of the ink chamber 1012. As a result of the movement, the ink i pulls air into the ink chamber 1012.

When air has been pulled into the ink chamber 1012, there is a danger that the air will remain in the ink chamber 1012 in air bubbles. Since air bubbles cause pressure loss in the ink chamber 1012, there is a possibility that the inkjet head will lose the desired ink shooting characteristic.

BRIEF SUMMARY OF THE INVENTION

It is an object of the present invention to provide an image recording apparatus with a maintenance mechanism which prevents air from being pulled into the ink chamber.

According to an aspect of the present invention there is provided an image recording apparatus comprising: an inkjet head which includes a nozzle plate where a plurality of nozzles that shoot ink are arranged in a column and an ink chamber which retains ink and is connected to said plurality of nozzles; at least one suction section which has a suction area larger than the nozzles; a suction section driving mechanism which causes the suction area to face the nozzles and moves the suction section relatively in the nozzle arrangement direction; and a positive pressure applying section which applies a positive pressure to the ink chamber, the suction section sucking in ink near the nozzles as moving in the nozzle arrangement direction, while the positive pressure is being applied to the ink chamber.

DETAILED DESCRIPTION OF THE INVENTION

Hereinafter, referring to the accompanying drawings, embodiments of the present invention will be explained.

Figure 1:
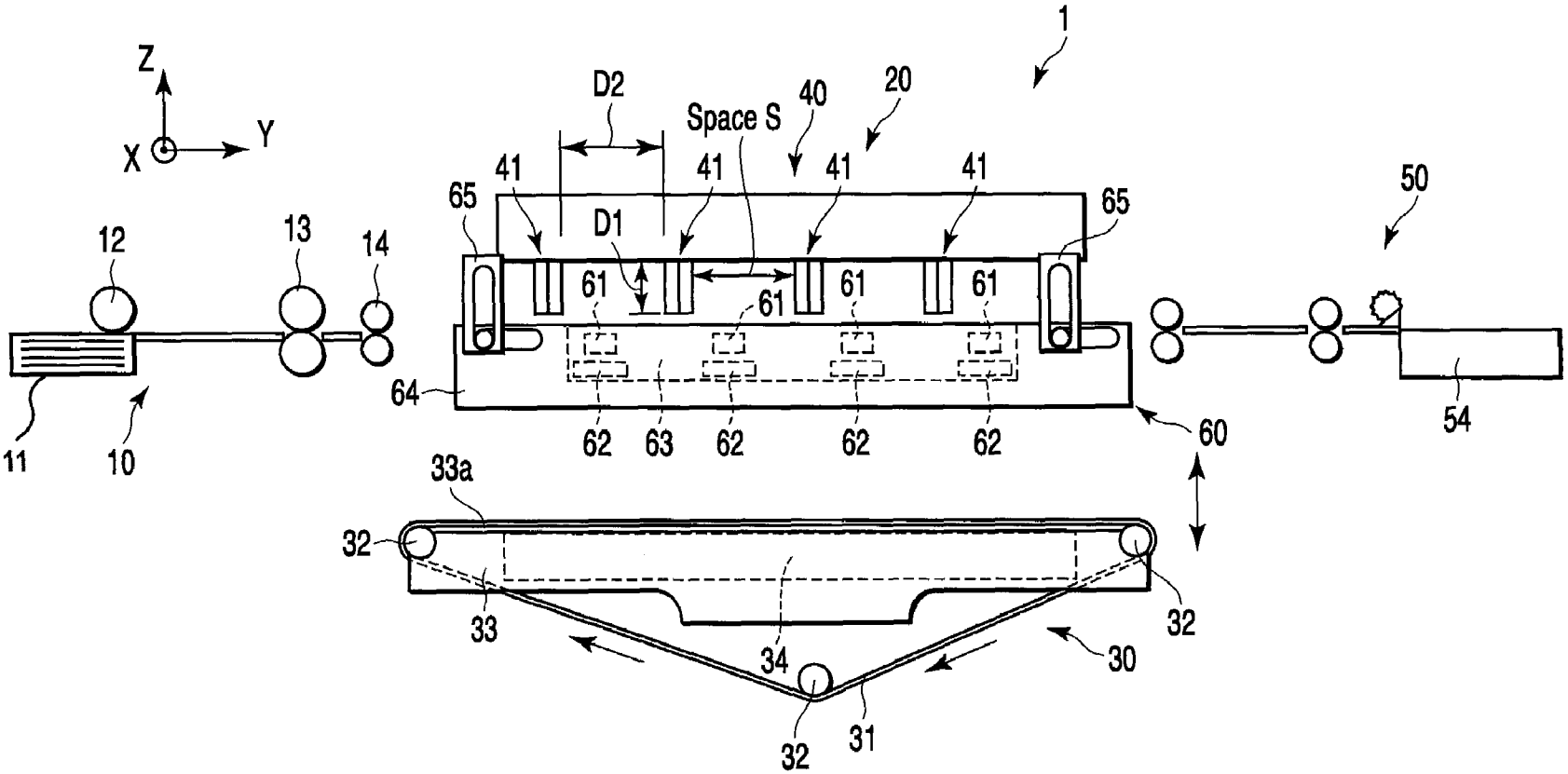
FIG. 1 is a schematic side view of an image recording apparatus according to an embodiment of the present invention.

First, an embodiment of the present invention will be explained. FIG. 1 is a schematic side view of an image recording apparatus of the embodiment.

Figure 9:
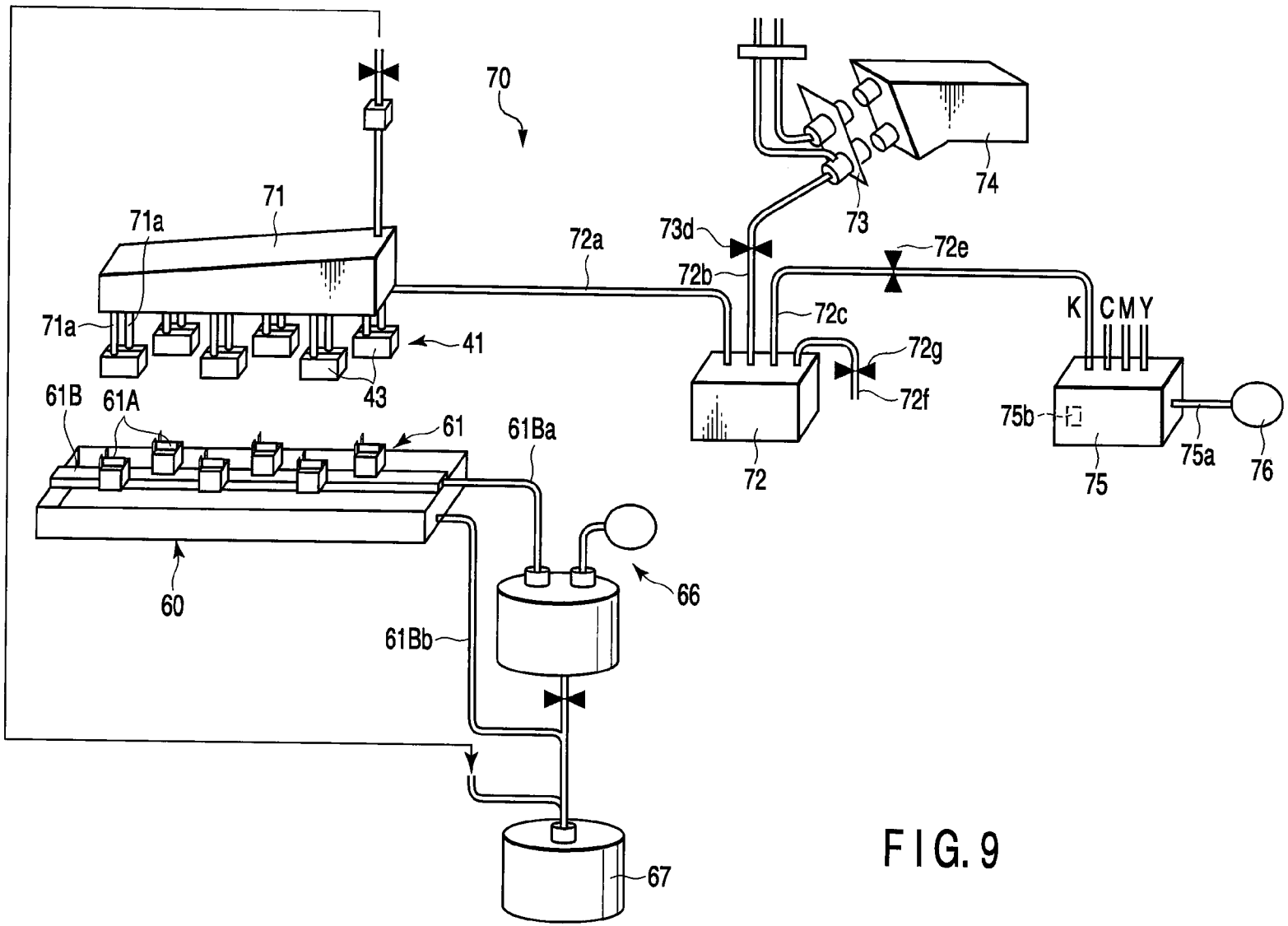
FIG. 9 schematically shows the ink supply section.
Figure 10:
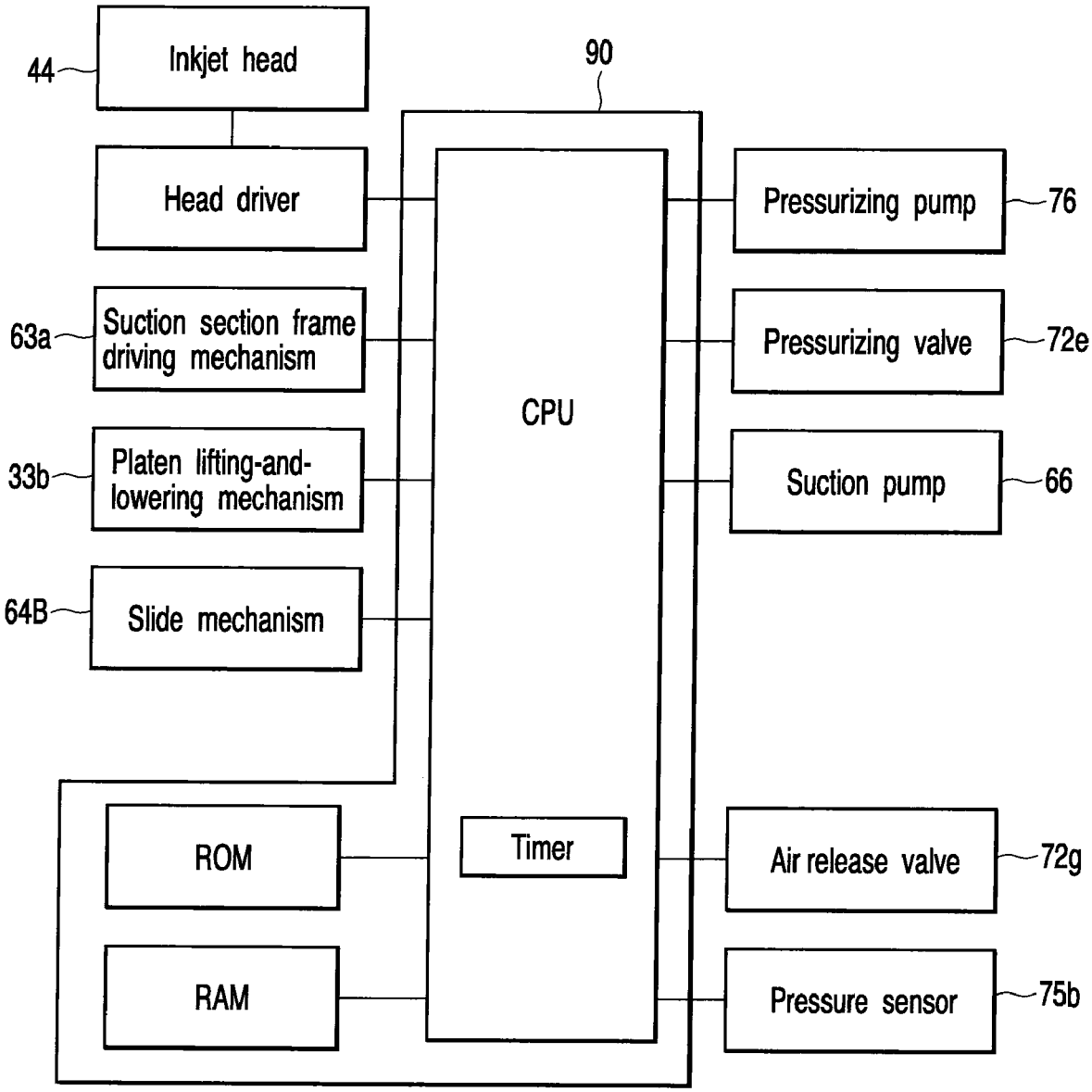
FIG. 10 is a block diagram of the control section.

The image recording apparatus 1 comprises a paper feed section 10, an image recording section 20, a paper discharge section 50, a maintenance section 60, an ink supply section 70 (see FIG. 9), and a control section 90 (see FIG. 10).

First, the paper feed section 10 will be explained.

As shown in FIG. 1, the paper feed section 10 is composed of a feeder tray 11, a pickup roller 12, a registration roller pair 13, and a paper feed roller pair 14. In the paper feed section 10, recording mediums loaded in the feeder tray 11 are taken out one by one by the pickup roller 12. The registration roller pair 13 on the downstream side in the transport direction makes alignment (or correction of inclined lines) in the transport direction during image recording.

Then, the aligned recording medium is transported by the paper feed roller pair 14 to the image recording section 20. Suppose the center of the axis of the recording medium in the transport direction is the Y-axis (from left to right in FIG. 1). Suppose the center of the axis perpendicular to the Y-axis in the image forming face during image recording is the X-axis (the direction perpendicular to the sheet in FIG. 1). In addition, suppose the center of the axis of perpendicular to the X-axis and Y-axis is the Z-axis (the up-and-down direction in FIG. 1). Therefore, in the embodiment, the registration roller pair 13 causes not only the width direction of the recording medium to practically coincide with the X-axis, but also the direction perpendicular to the width direction of the recoding medium to coincide with the Y-axis. While in the embodiment, explanation will be given on the assumption that the Z-axis extends vertically and the X-axis and Y-axis are parallel with the horizontal plane, the X-axis, Y-axis, and Z-axis are not limited to the above setting.

Next, the image recording section 20 will be explained.

The image recording section 20 includes a platen section 30 and an ink shooting section 40. First, the platen section will be explained by reference to FIG. 1.

[Platen Section]

The platen section 30 is a transport unit which transports the recording medium sent from the paper feed section 10 during image recording. The platen section 30 is composed of a platen belt 31, a plurality of platen belt rollers 32, a platen frame 33, and a platen suction section 34.

With the configuration of the platen belt 31 and the platen belt rollers 32, the recording medium is transported along the Y-axis. A motor is connected to at least one of the plurality of platen belt rollers 32. Being driven by the motor, the platen belt 31 revolves around the platen rollers, thereby transporting the recording medium. A plurality of holes (not shown) are made throughout the platen belt 31.

The platen frame 33 not only supports the platen belt rollers 32 rotatably but also holds the platen suction section 34. The platen frame 33 has a platen frame head facing side 33*a* which faces the ink shooting section 40. The platen frame head facing side 33*a* is parallel with the plane extending along the X-axis and Y-axis. In the platen frame head facing side 33*a*, facing-side holes (not shown) are arranged uniformly all over the area facing the platen belt 31. The platen frame 33 is moved up and down along the Z-axis by a platen lifting and lowering mechanism 33*b* (see FIG. 10). The dimensions of the platen frame head facing side 33*a* are so set that, when the platen frame 33 moves upward, it presses against the maintenance section 60.

The platen suction section 34 is a negative pressure generating unit for generating a negative pressure at the platen frame head facing side 33*a*. The platen suction section 34 is fixed to the side opposite to the side facing the inkjet on the platen frame head facing side 33*a*. The platen suction section 34, which has a negative pressure generating source (not shown), is configured so as to suck in air from the facing-side holes in the platen frame head facing side 33*a* by making the pressure at the platen suction section 34 negative, thereby sticking to the recording medium being transported by the platen belt 31.

[Ink Shooting Section]

Figure 2:
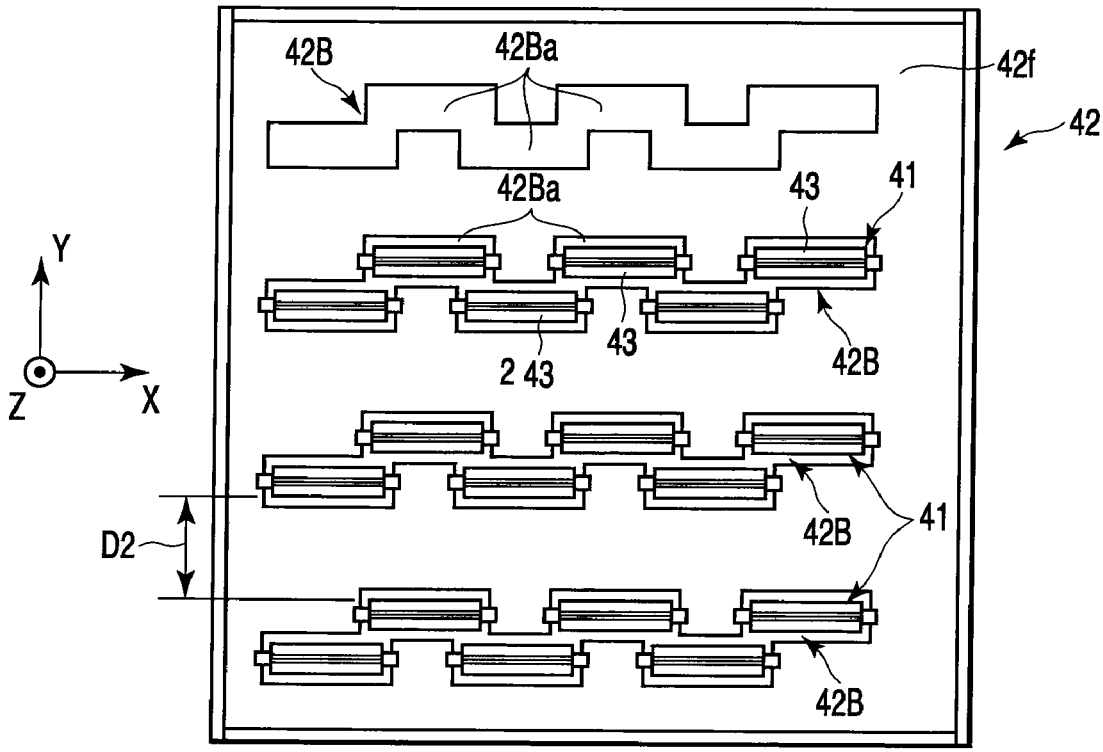
FIG. 2 is a schematic top view of the carriage of the image recording apparatus in FIG. 1.

The ink shooting section 40 is composed of a plurality of ink head columns 41 and a carriage 42 for holding the ink head columns 41. FIG. 2 is a schematic top view of the carriage 42, and shows a top face 42*f* of the carriage 42.

The ink shooting section 40 is composed of a plurality of ink head columns 41 and a carriage 42 for holding the ink head columns 41.

The ink head columns 41, each of which has a different color, extend as long as or longer than the maximum width of the recording medium used. In the embodiment, the ink shooting section has a total of four ink head columns 41: a black (K) head column, a cyan (C) head column, a magenta (M) head column, and a yellow (Y) head column. These ink head columns 41 are hung over the carriage 42 as shown in FIG. 2.

The ink head columns 41 will be explained in detail by reference to FIGS. 1 to 4. Each of the ink head columns 41 is configured by arranging a plurality of ink head units 43 (explained later in detail) in a column in such a manner that their longitudinal directions are caused to coincide with one another. In the embodiment, the ink head column 41 is composed of six ink head units 43 arranged along the X-axis. The number of ink head units 43 constituting the ink head column 41 is changed according to the width of the recording medium used.

Figure 3:
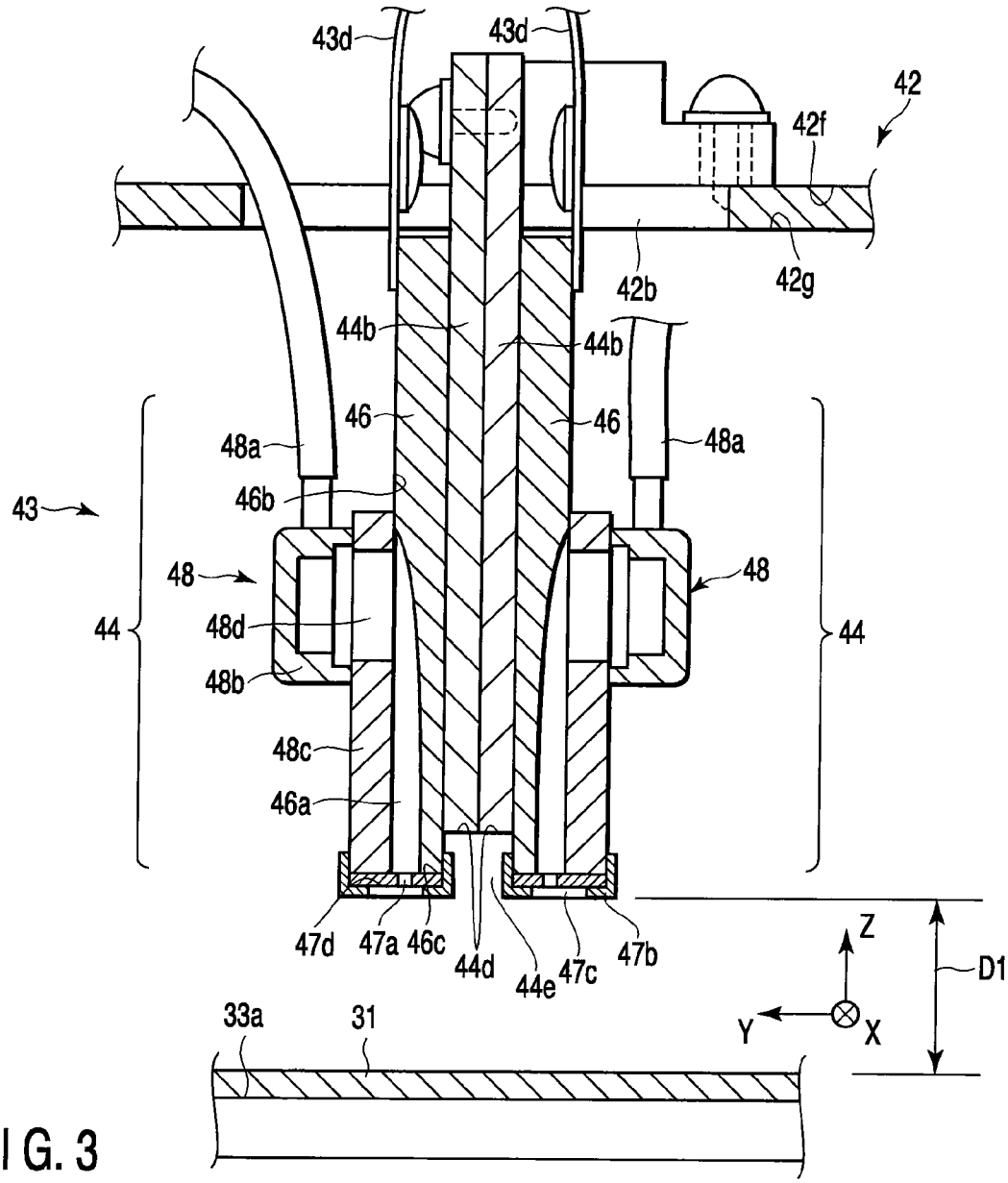
FIG. 3 is a sectional view of the ink head unit in FIG. 2.

Each of the ink head columns 41 is so hung over the carriage 42 that, when it is provided in a carriage hole 42B, the head tip is located at a distance of D1 from a surface of the belt 31 along the Z-axis as shown in FIG. 3. When each of the ink head columns is provided in the carriage hole 42B, these ink head columns 41 are arranged along the X-axis as shown in FIG. 2. The ink head columns 41 are spaced at least a distance of D2 apart in the Y-axis direction. Since the ink head columns 41 are arranged on the carriage 42, a space of S is allowed between adjacent ink head columns 41 (see FIG. 1).

As shown in FIG. 2, the carriage 42 has a plurality of carriage holes 42B arranged at specific intervals in the Y-axis direction. Each of the carriage holes 42B, which extends along the X-axis, is large enough to allow the ink head column 41 to be inserted in, and is formed by a plurality of spaces 42Ba, each of which accommodates one of the ink head units 43, as shown in FIG. 2. While in FIG. 2, the ink head column 41 is provided in each of the carriage holes 42, one of the four ink head columns 41 is omitted for the sake of explanation. The carriage 42 has a recording medium facing side 42*g* that faces the recording medium during image recording. The recording medium facing side 42*g* is provided so as to be parallel with the plane passing through the X-axis and the Y-axis.

Next, the ink head unit 43 will be explained in detail.

The ink head unit 43 is composed of at least one inkjet head 44. In the embodiment, the ink head unit 43 is composed of two inkjet heads 44 as shown in FIG. 3. FIG. 3 is a sectional view of the ink head unit 43 in FIG. 2. First, the configuration of each of the inkjet heads 44 will be explained.

As shown in FIG. 3, each of the inkjet heads 44 includes a piezoelectric unit 46, a head base plate 44*b*, a nozzle plate 47, and a head ink distribution section 48.

Figure 4:
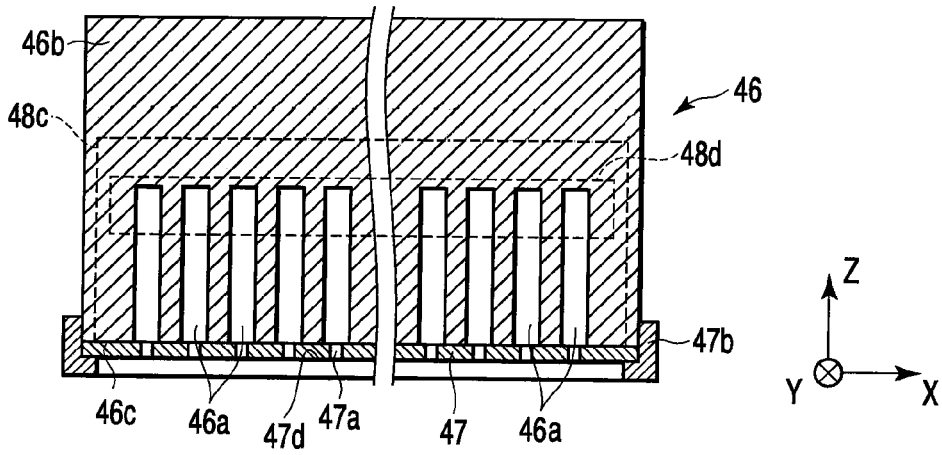
FIG. 4 is a sectional view of the piezoelectric unit in FIG. 2.

The piezoelectric unit 46 is shooting force applying means for exerting forces on the ink to be shot (shooting force). As shown in FIG. 4, the piezoelectric unit 46 includes a groove forming face 46*b* in which a plurality of piezoelectric grooves 46*a* are made and a nozzle plate mounting face 46*c* on which the nozzle plate 47 is mounted. The nozzle plate mounting face 46*c* extends in a direction perpendicular to the groove forming face 46*b*. In FIG. 3, the groove forming face 46*b* extends in the Z-axis direction and the nozzle plate mounting face 46*c* extends in the X-Y plane direction.

Each of the piezoelectric grooves 46*a* has a groove-forming-face-side opening in the groove forming face 46*b*. Moreover, each of the piezoelectric grooves 46*a* extends in a direction (width direction) (the up-and-down direction in FIG. 4) perpendicular to the longitudinal direction (the X-axis in FIG. 4) of the piezoelectric unit 46 in a plane along the groove forming face 46*b*. These piezoelectric grooves 46*a* are arranged with a specific pitch in the longitudinal direction (from left to right in FIG. 4) of the piezoelectric unit 46. One end of the piezoelectric groove 46*a* opens at the nozzle plate mounting face 46*c*. The other end of the piezoelectric groove 46*a* does not reach the opposite face to the nozzle plate mounting face 46*c* in the width direction (the Z-axis in FIG. 4). Although not shown to simplify the figure, each of the piezoelectric grooves 46*a* has a nozzle electrode which extends from its other end in the width direction over the nozzle plate mounting face 46*c*.

Each of the nozzle electrodes is connected to the control section 90 via a flexible substrate 43*d* as shown in FIG. 3. To these piezoelectric grooves 46*a*, the control section 90 selectively applies a driving voltage via the flexible substrate 43*d* and nozzle electrode. In the embodiment, the piezoelectric groove 46*a* to which the driving voltage is applied drives its inner wall, thereby changing its volume. The change of the volume enables the piezoelectric unit 46 to apply shooting forces to the ink in the piezoelectric groove 46*a*.

The head base plate 44*b* holds the piezoelectric unit 46 in such a manner that the nozzle plate mounting face 46*c* protrudes more than the nozzle-side base plate face 44*d* in the longitudinal direction of the head base plate 44*b* (in the Z-axis direction in FIG. 3). The nozzle plate mounting face 46*c* and the nozzle-side base plate face 44*d* are arranged so as to differ in position in the longitudinal direction but be practically parallel with each other.

The head base plate 44*b*, which is a flat plate made of, for example, aluminum, does the job of a heat sink to cool the piezoelectric unit 46. The head base plate 44*b* has a piezoelectric unit holding face for holding the piezoelectric unit (the left face in FIG. 3) and a nozzle-side base plate face 44*d* (the lower face in FIG. 3) practically perpendicular to the piezoelectric holding face.

Figure 5:
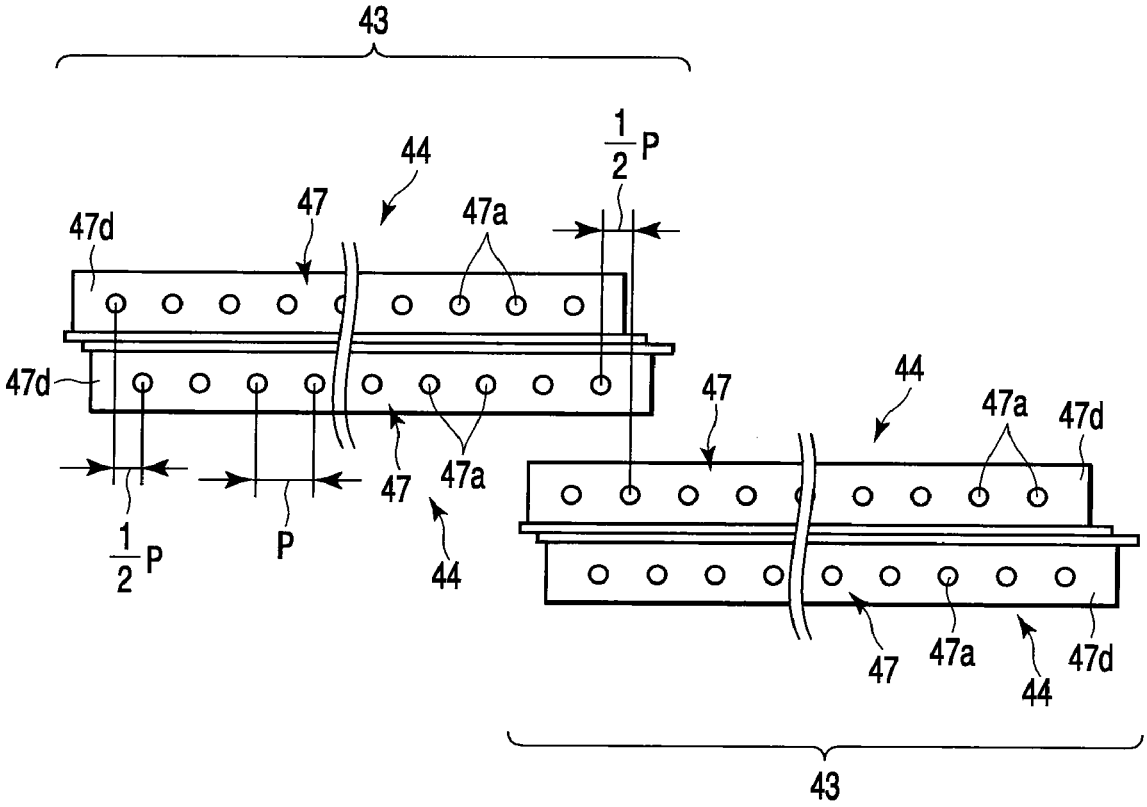
FIG. 5 schematically shows a combination of ink head units.

As shown in FIG. 4, the nozzle plate 47, which is mounted on the nozzle plate mounting face 46*c* of the piezoelectric unit 46, covers the entire nozzle plate mounting face 46*c*. When the nozzle plate 47 is mounted on the piezoelectric unit 46, the longitudinal direction of the nozzle plate 47 practically coincides with the longitudinal direction of the piezoelectric unit 46. At the nozzle plate 47, a plurality of nozzles 47*a*, ink shooting outlets, are formed. The individual nozzles 47*a* are provided in the positions corresponding to the piezoelectric grooves 46*a* in the piezoelectric unit 46 and are connected to the piezoelectric grooves 46*a*. These nozzles 47*a* are arranged with a specific pitch P in the longitudinal direction of the nozzle plate 47 as shown in FIG. 5.

The pitch P is set according to the image recording density. For example, in the embodiment, one inkjet head 44 is set so as to be capable of recording an image of 180 dpi. In this case, the pitch P is set to about 0.14 mm. While in the embodiment, one nozzle 47*a* is formed for each piezoelectric groove, the number of nozzles 47*a* is not limited. In the embodiment, each of the inkjet heads 44 shoots ink practically along the Z-axis. The direction in which ink is shot is not limited to the Z-axis and may be arbitrary.

The nozzle plate 47 has a nozzle forming face 47*d* (the lower face in FIG. 3) which faces the recording medium during image recording. The nozzle forming face 47*d* is water-repellent. Moreover, the nozzle plate 47 is covered with a nozzle plate cover 47*b* as shown in FIGS. 3 and 4. The nozzle plate cover 47*b* has a cover hole 47*c* in a position corresponding to the nozzle column. The cover hole 47*c*, which extends practically across the nozzle plate 47 in the longitudinal direction, has a width greater than the diameter of the nozzle hole. Therefore, the nozzle plate cover 47*b* covers the nozzle plate 47 in such a manner that the nozzle column and its vicinity are exposed through the cover hole 47*c*. In the embodiment, the nozzle plate cover 47*b* is made of a material less water-repellent than the nozzle plate 47.

The head ink distribution section 48, which is connected to the ink supply section 70 (see FIG. 9), distributes ink from the ink supply section 70 to each piezoelectric groove 46*a*. The head ink distribution section 48 includes a distributor tube 48*a*, a small ink container 48*b*, and an ink distribution plate 48*c*.

The distributor tube 48*a* is an ink passage for supplying ink from the ink supply section 70 to the head ink distribution section 48. One end of the distributor tube 48*a* is connected to the ink supply section 70 and the other end is connected to the small ink container 48*b*.

The small ink container 48*b* has a connecting plug to which the other end of the distributor tube 48*a* is connected. The small ink container 48*b* holds ink flowing in through the connecting plug. The small ink container 48*b* is fixed to the ink distribution plate 48*c*.

The ink distribution plate 48*c* is fixed to the groove forming face 46*b* of the piezoelectric unit 46 so as to cover the groove-forming-face-side openings of all the piezoelectric grooves 46*a*. Therefore, the ink distribution plate 48*c* is provided between the small ink container 48*b* and the piezoelectric unit 46 in a direction perpendicular to the groove forming face 46*b* (from left to right in FIG. 3). The ink distribution plate 48*c* has an ink chamber 48*d* extending in the longitudinal direction of the piezoelectric unit 46 as shown in FIGS. 3 and 4. The ink chamber 48*d* faces the other-end side of each piezoelectric groove 46*a*.

The ink chamber 48*d* is connected to the small ink container 48*b* and all of the piezoelectric grooves 46*a*. The ink chamber 48*d* retains ink from the small ink container 48*b* and distributes the ink to each piezoelectric groove 46*a*.

As shown in FIG. 3, the inkjet head 44 configured as described above is laminated to another inkjet head 44, thereby constituting the ink head unit 43. In the laminating process, the two inkjet heads 44 have their head base plates 44*b* laminated together. In the inkjet head 44 assembled in this way, the nozzle forming faces 47*d* of the nozzle plates 47 are set so as to be positioned essentially in the same plane as shown in FIG. 3. With this arrangement, the nozzle-side base plate faces 44*d* of the head base plates 44*b* are positioned so as to align with one another.

Furthermore, as shown in FIG. 3, the nozzle-side base plate face 44*d* and two piezoelectric units 46 constitute a guide groove 44*e*. The guide groove 44*e*, which extends practically across the inkjet head 44 in the longitudinal direction, guides the maintenance suction section 61A of the maintenance section 60.

When the ink head unit 43 is assembled, the nozzle columns of the individual inkjet heads 44 constituting the unit 43 are set so as to be in parallel with one another as shown in FIG. 5. As shown in FIG. 5, the nozzles 47*a* of one inkjet head 44 are shifted from the nozzles 47*a* of the other inkjet head 44 by half of a pitch P of the nozzles of one inkjet head 44 in the direction in which the nozzles are arranged. Therefore, the ink head unit 43 records an image with a resolution of 360 dpi, twice the resolution of a single inkjet head 44.

As described above, the ink head column 41 is constructed by arranging the ink head units 43 along the X-axis. In this arrangement, the ink head column 41 has the nozzles of the individual inkjet heads 44 positioned so as to record an image with uniform consistency along the X-axis. Therefore, the ink head columns 41 are arranged with practically a uniform pitch along the X-axis.

In the embodiment, when the ink head columns 41 are mounted on the carriage 42, the face on the side fading the nozzle forming face 47*d* of the nozzle plate 47 and the recording medium of the nozzle plate cover is made parallel with the X-Y plane. The X-Y plane in the embodiment extends horizontally. However, the direction in which these faces extend is not limited to the horizontal direction and may be inclined with respect to the horizontal plane.

Next, the paper discharge section 50 will be explained.

(Paper Discharge Section)

The paper discharge section 50 is a mechanism for discharging a recording medium on which an image has been recorded by the image recording section 20. The paper discharge section 50 discharges the recording medium sent from the image recording section 20 to a catch tray 54.

Next, the maintenance section 60 will be explained.

(Maintenance Section)

The maintenance section 60 is composed of a plurality of maintenance units 61, a plurality of maintenance ink pans 62, a maintenance suction section frame 63, a transport direction guide frame 64, and four lifting-and-lowering guide frames 65.

The individual maintenance units 61 are provided so as to correspond to the positions of the four ink head columns 41. Specifically, the maintenance units 61 are arranged at specific intervals along the Y-axis as are the ink head columns 41. Each of the maintenance units 61 is composed of a plurality of maintenance suction sections 61A. Specifically, each of the maintenance units 61 is constructed by arranging a plurality of maintenance suction sections 61A along X-axis. In the embodiment, each of the maintenance units 61 has six maintenance suction sections 61A, the same number of ink head units 43 constituting each ink head column 41.

Each of he maintenance units 61 has a base plate 61B which holds six maintenance suction sections 61A. Each of the base plates 61B, which is fixed to the maintenance suction section frame 63, extends along the X-axis. On the base plate 61B, the six maintenance suction sections 61A are arranged in the same manner as the ink head units 43 constituting each ink head column 41. That is, during maintenance explained later, when the maintenance unit 61 is aligned with the ink head column 41, each maintenance suction section 61A is provided in a position facing the corresponding ink head unit 43.

Each of the base plates 61B is connected to a suction pump 66 (see FIG. 9) for applying suction to each maintenance suction section 61A during maintenance via a suction tube 61Ba. In addition, each of the base plates 61B includes a passage (not shown) which connects the suction tube 61Ba to each of the maintenance suction sections 61A. Therefore, each of the maintenance suction sections 61A can apply suction when the pressure of the suction pump 66 is made negative.

The maintenance ink pans 62 are ink catchers for preventing ink from scattering during maintenance. There are provided as many maintenance ink pans 62 as there are maintenance units 61. The maintenance ink pans 62 are provided in positions corresponding to the maintenance units 61. Specifically, the individual maintenance ink pans 62 are provided opposite to the ink head columns 41 along the Z-axis, with the maintenance units 61 between the pans and the ink head columns 41. In the embodiment, the maintenance ink pans 62 are provided below the maintenance units 61.

Each of the maintenance ink pans 62 has its dimensions along the X-axis and Y-axis set equal to or larger than those of the maintenance unit 61. Each maintenance pan 62 has its position to the maintenance unit 61 set so as to recover ink drips from the maintenance unit 61. As explained later, the Y-axis dimensions of the maintenance ink pan 62 on the Y-axis are set so that the maintenance ink pan 62 may retreat into a space S between the ink head columns 41 during image recording. Specifically, the dimensions on the Y-axis of the maintenance ink pan 62 are set smaller than the distance D2.

The maintenance ink pan 62 is also fixed to the maintenance suction section frame 63. The arrangement of the maintenance ink pans 62 along Z-axis when being fixed is set so that the maintenance ink pans 62 may retreat into a space S between the ink head columns 41 during image recording. Specifically, on the Z-axis, the maintenance pan 62 is so provided that its lower end (the end on the opposite side to the ink head column) will not be positioned below the tip of the ink head column, when image recording is done.

The maintenance ink pan 62 is connected to a waste fluid tank 67 via a waste fluid tube 61Bb (see FIG. 9). This enables the maintenance ink pans 61 to discharge received ink to the waste fluid tank 67.

The maintenance suction section frame 63 holds all of the maintenance units 61 as described above. The maintenance suction section frame 63 is supported movably by the transport direction guide frame 64 via a pair of suction section frame driving mechanisms 63*a*. The pair of suction section frame driving mechanisms 63*a* support the maintenance suction section frame 63 at both its ends in the Y-axis direction.

The pair of suction section frame driving mechanisms 63*a* is a maintenance suction section driving mechanism for moving each maintenance suction section 61A along the nozzle column of the corresponding inkjet head 44 via the maintenance suction section frame 63. Specifically, the pair of suction section frame driving mechanisms 63*a*, which extend along the X-axis, move the maintenance suction section frame 63, which holds the maintenance units 61 that support the maintenance suction sections 61A, along the X axis. Therefore, when the suction section frame driving mechanisms 63*a* are driven, each maintenance suction section 61A is moved along the X-axis, which is the direction in which the nozzles 47*a* in each inkjet head 44 are arranged. Therefore, it can be said that the suction section frame driving mechanisms 63*a* are a mechanism for moving each maintenance suction section 61A in the direction in which the nozzles are arranged. The pair of suction section frame driving mechanisms 63*a* is configured to move at least the maintenance suction section frame 63 along the nozzle column all over the inkjet head 44.

The transport direction guide frame 64 has a pair of sidewalls 64A along the Y-axis. On both ends of each of the sidewalls 64A, transport direction guide grooves 64Aa, which extend along the Y-axis, are provided.

In addition, the transport direction guide frame 64 has a slide mechanism 64B which provides driving forces along the Y-axis.

Figure 6:
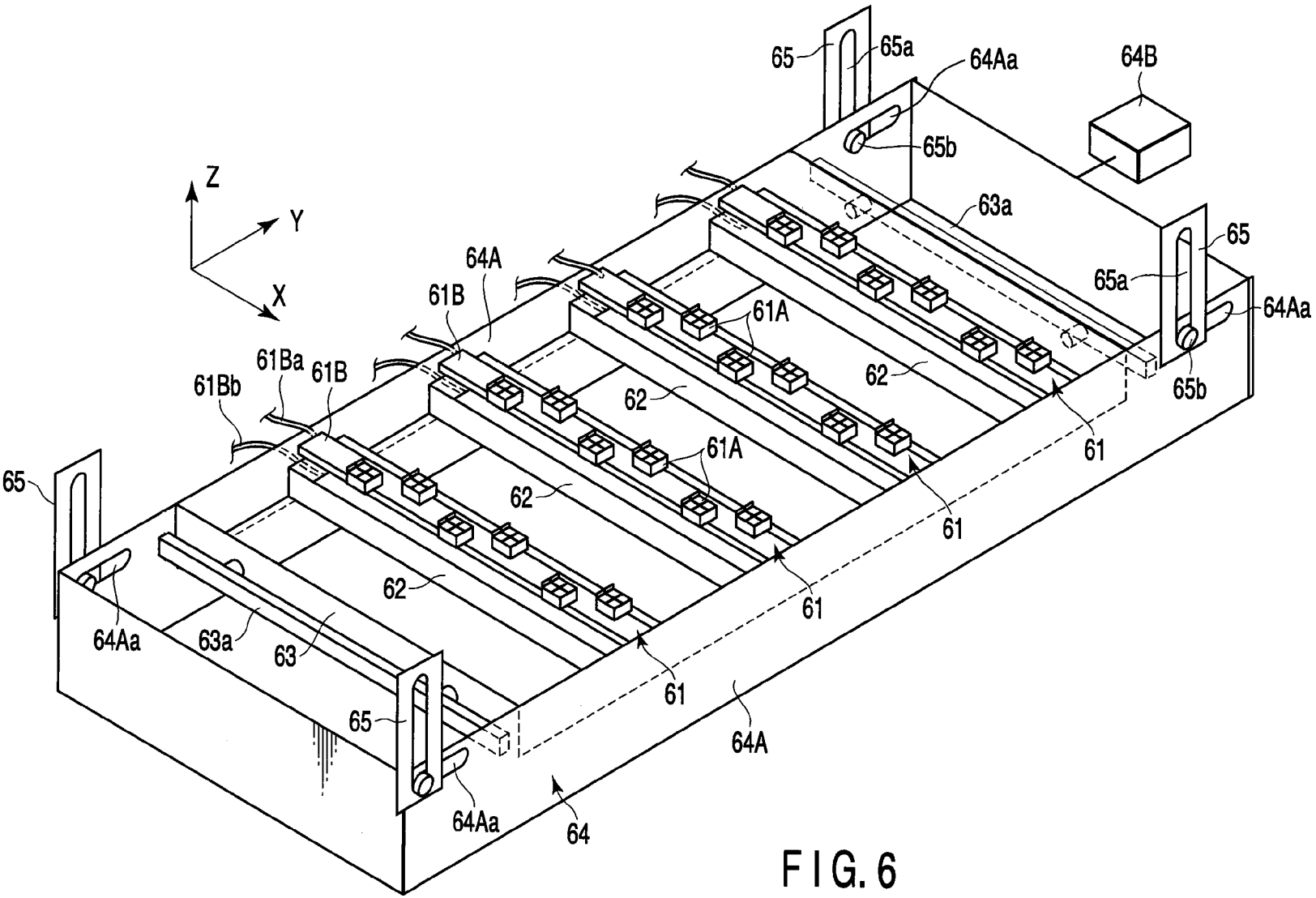
FIG. 6 is a schematic perspective view of the maintenance section.

The four lifting-and-lowering guide frames 65 are supporting members for supporting the transport direction guide frame 64 in such a manner that the guide frame 64 can move in the Z-axis direction. These lifting-and-lowering guide frames are fixed to the frame (not shown) of the image recording apparatus 1. The lifting-and-lowering guide frames 65 are provided in positions corresponding to the transport direction guide grooves 64Aa. Moreover, each of the lifting-and-lowering guide frames 65 has a lifting-and-lowering guide groove 65*a* along the Z-axis. The individual lifting-and-lowering guide grooves 65*a*, which are aligned with the corresponding transport direction guide grooves 64Aa, are connected to the transport direction guide grooves 64Aa by connecting members, such as pins 65*b*, inserted so as to run through these grooves. This causes the lifting-and-lowering guide frame 65 to support the transport direction guide frame 64 movably along the Y-axis and Z-axis as shown in FIG. 6.

The slide mechanism 64B applies driving forces to the transport direction guide frame 64 along the Y-axis, thereby moving the frame 64 along the Y-axis.

As explained above with respect to the platen section 30, when the platen frame 33 moves upward, it presses against the maintenance section 60. Thus, by moving the platen section 30 upward, the transport direction guide frame 64 can be moved upward, since the transport direction guide frame 64 is pressed against by the platen frame head facing side 33*a*, when the platen frame 33 moves upward. With this configuration, the transport direction guide frame 64 can be moved along the Z-axis according the up-and-down movement of the platen frame 33. Since the transport direction guide frame 64 moves together with the platen frame 33, its dimensions on the Z-axis are set so as not to interfere with the movement of the platen frame 33.

While in the embodiment, the platen frame 33 applies driving forces to the transport direction guide frame on the Z-axis, another independent driving means may apply driving forces.

Figure 7:
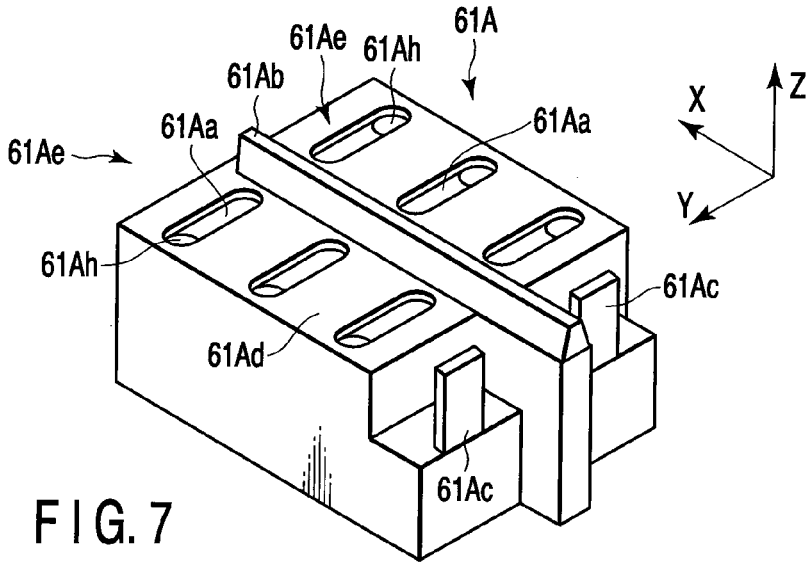
FIG. 7 is a schematic perspective view of the maintenance suction section.

Hereinafter, the maintenance suction section 61A will be explained in detail by reference to FIGS. 7 and 8.

The maintenance suction section 61A is suction means for cleaning by sucking in ink or dust adhering to each ink head unit 43. As shown in FIG. 7, the maintenance suction section 61A includes a plurality of suction openings 61Aa, a guide projecting part 61Ab, and a wiper blade 61Ac. The maintenance suction section 61A further includes a suction section head facing side 61Ad which faces the ink head unit 43 during maintenance. The suction openings 61Aa are shaped like grooves one step lower than the suction section head facing side 61Ad.

The suction openings 61Aa are openings of suction inlets when the maintenance suction section 61A applies suction. Therefore, the suction opening 61Aa decides the suction range of the maintenance suction section 61A. The suction openings 61Aa, which are arranged in a column on the suction section head facing side 61Ad, constitute a suction opening column 61Ae. In the embodiment, two suction opening columns 61Ae are arranged symmetrically with 61Ab. Each suction opening column 61Ae is composed of three suction opening sections 61Aa. Each of the suction opening columns 61Ae faces the corresponding inkjet head 44 during maintenance. At this time, the longitudinal direction of the inkjet head 44 basically coincides with the direction in which the suction openings 61Aa are arranged. In other words, the direction in which the suction openings 61Aa are arranged practically coincides with the direction in which the nozzle columns are arranged.

In the above arrangement, each suction opening 61Aa has a larger diameter than that of the nozzle 47*a* in the (X-axis) direction in which they are arranged. Therefore, the suction area determined by the each suction opening 61Aa is larger than the nozzle 47*a*. In the embodiment, each suction opening 61Aa has almost the same size as the width of the inkjet head 44 on the X-axis. More specifically, each suction opening

61Aa has almost the same size as that of the nozzle plate cover 47*b* of the inkjet head 44 in the Y-axis direction.

Furthermore, the ink suction opening 61Aa has a fluid passage 61Af connected to the suction tube 61Ba. Therefore, each suction opening 61Aa is connected to the suction pump 66 via the fluid passage 61Af and suction tube 61Ba. Therefore, when the pressure of the suction pump 66 is made negative, the fluid sucked in by the suction opening 61Aa is sucked in by the suction pump 66 via the fluid passage 61Af. That is, the fluid passage 61Af is a passage for the sucked-in fluid.

Figure 8:
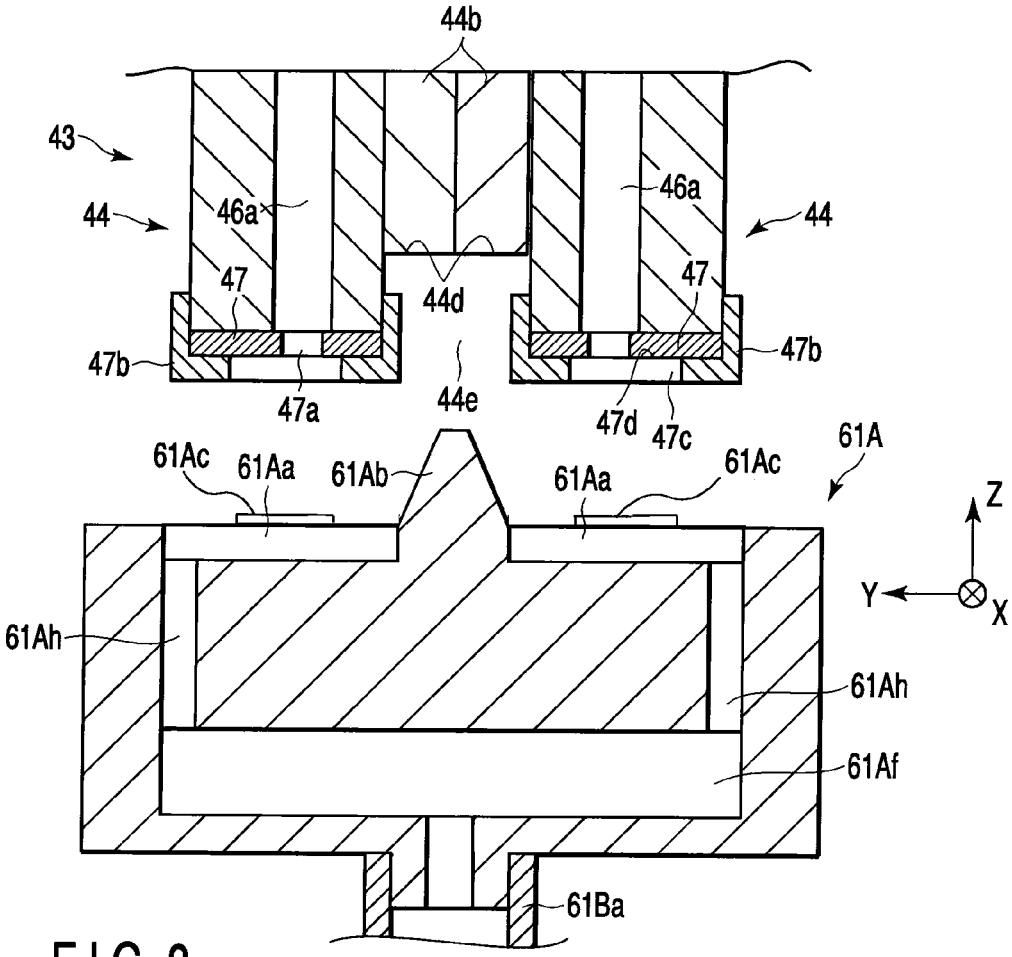
FIG. 8 is a sectional view of the maintenance suction section.

More specifically, the fluid passage 61Af has an inlet hole 61Ah open at each suction opening 61Aa as shown in FIG. 8.

The inlet hole 61Ah is set within the suction opening 61Aa in such a manner that it does not face the nozzle 47*a*. In the embodiment, the inlet hole 61Ah is provided at the end of the suction opening 61Aa opposite to guide projecting part 61Ab in the Y-axis direction. More specifically, the inlet hole 61Ah is provided at the outside end with respect to the central part of the maintenance suction section 61A in the Y-axis direction so as to face the nozzle plate cover 47*b*.

The guide projecting part 61Ab extends practically in the same direction as that in which the suction opening columns 61Ae are arranged. The guide projecting part 61Ab is configured to be capable of being inserted into the guide groove 44*e* in the ink head unit 43. The guide projecting part 61Ab is set above the maintenance suction section 61A in such a manner that, when it is inserted into the guide groove 44*e*, the direction in which the suction opening columns 61Ae are arranged is basically in parallel with the nozzle column of each inkjet head 44. At the same time, the guide projecting part 61Ab is so set that, when it is inserted into the guide groove 44*e*, each inlet hole 61Ah is aligned with the nozzle plate cover 47*b* of the corresponding inkjet head 44 as described above.

The wiper blade 61Ac is wiping means for wiping the surface facing the recording medium when the inkjet head 44 records an image. There are provided as many wiper blades 61Ac as there are the inkjet heads 44 in the ink head unit 43. In the embodiment, two wiper blades 61Ac are provided in each maintenance suction section 61A. Each wiper blade 61Ac is a little smaller than the nozzle forming face 47*d* in the Y-axis direction. Each wiper blade 61Ac is placed practically in the same position as that of the nozzle forming face 47*d* on the X-axis. The wiper blades 61Ac are made of a known elastic member, such as rubber. As shown in FIG. 7, the wiper blades 61Ac project from the suction section head facing side 61Ad. A part shaped like a concave in the Z-axis direction is provided between the wiper blades 61Ac and the suction section head facing side 61Ad in the X-axis direction.

Next, the ink supply section 70 will be explained.

(Ink Supply Section)

As shown in FIG. 9, the ink supply section 70 includes an ink distributor 71, a main ink tank 72, an ink bottle connecting section 73, an ink bottle 74, an air tank 75, and a pressurizing pump 76.

The ink distributor 71 distributes ink to each ink head unit 43 in the ink head column 41. The ink distributor 71 is provided above the ink head column 41. In the ink distributor 71, ink is retained temporarily. The ink distributor 71 has a distribution ink tube 71*a* connected to the inkjet head 44 in each ink head unit 43. The ink in the ink distributor 71 is supplied to each inkjet head 44 via the distribution ink tube 71*a* in a pressurizing process explained later.

The main ink tank 72 is a rigid container, such as a plastic container, capable of being filled with ink. The main ink tank 72 is connected to the ink distributor 71 via the main tank ink tube 72*a* and to the ink bottle connecting section 73 via the ink supply tube 72*b*.

Furthermore, the main ink tank 72 is provided with an air release tube 72*f* connected to the air and a valve (air release valve) 72*g* in the tube which selectively enables or disables the connection to the air. When the air release valve 72*g* is opened, the main ink tank 72 is exposed to atmospheric pressure.

To set the inside of the ink distributor 71 at a specific water head pressure when the main ink tank 72 is made open to the air, the main ink tank 72 is provided below the ink head column 41. When the pressure in the ink distributor 71 has been set to the specific water head pressure, the pressure in each ink chamber 48*d* in each inkjet head 44 becomes negative, forming a desired meniscus in the nozzle 47*a*. The main ink tank 72 is connected to the air tank 75 via the air tube 72*c*. A pressurizing valve 72*e* is provided in the air tube 72*c*. The pressurizing valve 72*e* can open and close the air tube 72*c*.

The air tank 75 is an airtight rigid container, such as a plastic container. The air tank 75 is connected to the pressurizing pump 76 via a pressurizing pump tube 75*a*. When the pressurizing valve has been closed, the pressurizing pump 76 makes the pressure inside the air tank 75 positive. In the air tank 75, there is provided a pressure sensor 75*b*, which can detect the pressure in the air tank 75.

The ink bottle connecting section 73 is a connecting section to which the ink bottle 74 retaining ink is installed detachably. A replenish valve 73*d* is configured to be capable of selectively opening and closing the supply from the ink bottle 74 installed. When the replenish valve 73*d* opens the supply from the ink bottle 74, the main ink tank 72 is refilled with ink via the ink supply tube 72*b*.

In the ink supply section 70, the configuration from the air tube 72*c*. to the ink distributor 71 is provided for each ink head column 41. In other words, the air tubes 72*c* of all the ink head columns 41 are connected to the air tank 75. Therefore, the pressurizing pump 76 is a positive pressure applying section which supplies a positive pressure to all of the ink head columns 41.

Next, the control section 90 will be explained.

(Control Section)

As shown in FIG. 10, the control section 90 is composed of a computer, including a CPU, a timer, a ROM, and a RAM. The control section 90 provides open and close control of the air release valve 72*g* and pressurizing valve 72*e*, driving control of the pressuring pump 76 and suction pump 66, and driving control of the maintenance section 60 and platen lifting-and-lowering mechanism 33*b*. In addition, the control section 90 provides driving control of the inkjet heads via head drivers.

(Operation)

The image recording operation of the image recording apparatus 1 configured as described above will be explained.

(Image Recording Operation)

When an image is recorded with the image recording apparatus 1, image data is inputted to the control section 90 via an interface (not shown). Receiving the input image data, the control section 90 carries out an image recording process. At this time, in the maintenance section 60, the maintenance units 61 and maintenance ink pans 62 are set in the retreat position in the space S. In this way, when the maintenance units 61 and maintenance ink pans 62 are placed in the space S, they do not go beyond the tips of the inkjet heads 44 and project into the recording medium. Therefore, the maintenance section 60 is prevented from touching the recording medium improperly in the retreat position during image recording.

In the retreat position, the platen section 30 is placed in the recording medium transport position during image recording. When the platen section 30 and the maintenance section 60 are placed in a specific position, the paper feed section 10 takes a recording medium out of the feeder tray 11 and transports it to the image recording section 20. In the image recording section 20, the ink shooting section 40 shoots ink onto the recording medium transported by the belt 31, thereby forming an image. The recording medium on which an image has been formed is transported to the paper discharge section 50 and is held in the catch tray 54.

When an image is recorded, the control section 90 opens the air release valve 72*g* and closes the pressurizing valve 72*e*. As a result, the water head difference between the main ink tank 72 and ink head column 41 causes a negative pressure to be applied to the ink in the ink chamber 48*d* (see FIG. 3) in each inkjet head 44. With this negative pressure, the ink in each nozzle 47*a* connected to the ink chamber 48*d* via the piezoelectric groove 46*a* forms a meniscus. The water head difference is so set that a meniscus is formed in a desired position in the nozzle 47*a*. As a result, the surface tension of the meniscus formed in the desired position balances with the negative pressure. This prevents ink from leaking out of each nozzle 47*a*, unless the piezoelectric unit 46 applies shooting forces. Therefore, the image recording apparatus 1 with the above configuration can not only form an image by shooting ink at the desired time, but also prevent-ink from leaking at an unwanted time and contaminating the recording medium and/or the inside of the image recording apparatus 1.

In the main ink tank 72, an ink level sensor can be provided. The ink level sensor is connected to the control section 90. With this configuration, in the control section 90, when the ink level sensor the information senses that the ink level has dropped below a specific value, the replenish valve 73*d* opens the supply from the ink bottle 74, thereby replenishing the main ink tank 72 with ink via the ink supply tube 72*b*. With this configuration, the image recording apparatus 1 supplies ink automatically without troublesome work.

(Maintenance Operation)

Next, the maintenance operation of the image recording apparatus of the embodiment will be explained. This maintenance operation can be carried out with arbitrary timing, such as during the image recording process or at the time when power is applied, under the control of the control section 90. The timing may be set beforehand in the ROM within the control section 90. Alternatively, using input means (not shown) connected to the control section 90, the setting may be stored in the RAM.

In the maintenance operation, a plurality of processes explained below will be carried out.

First, a maintenance section positioning process is carried out.

[Maintenance Section Positioning Process]

Figure 11A:
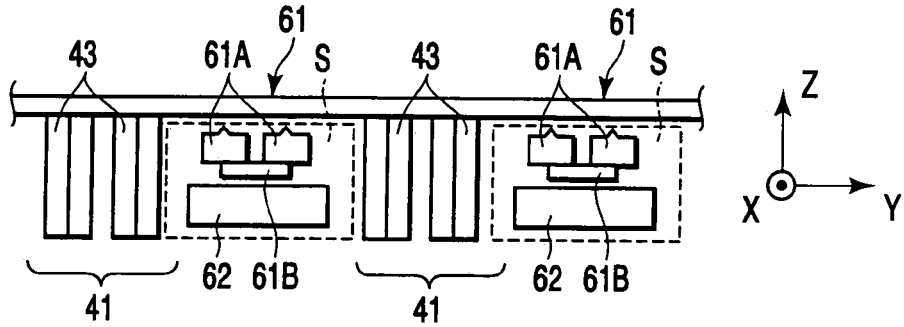
FIG. 11A is a schematic side view showing the arrangement of the maintenance section at the time of maintenance.
Figure 11B:
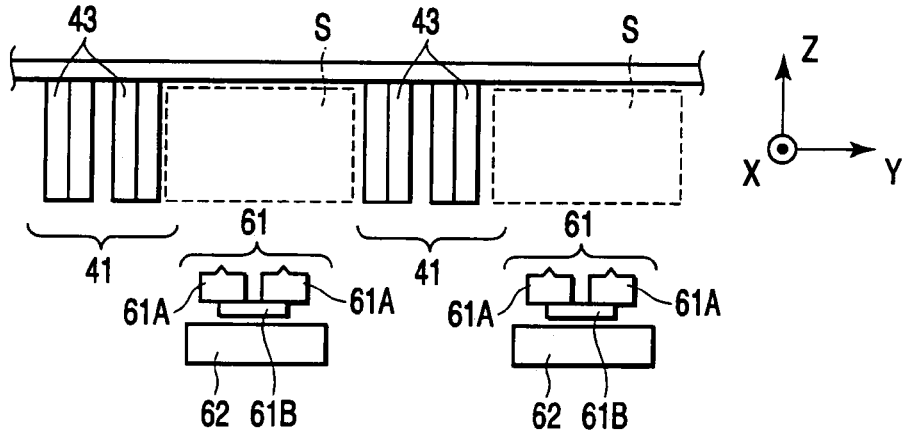
FIG. 11B is a schematic side view showing the arrangement of the maintenance section at the time of maintenance.

In the maintenance section positioning process, the platen section 30 is lowered to a position where the platen section is not pressed against the maintenance section 60 as shown in FIGS. 1 and 11B. As a result, the transport direction guide frame 64 is hung on the lifting-and-lowering guide frame 65 in such a manner that the upper end of the frame 64 (the upper end in FIGS. 1 and 11B) is a distance away from the recording-medium-side tip of the inkjet head 44 (the lower end in FIGS. 1 and 11B) on the Z-axis.

Figure 11C:
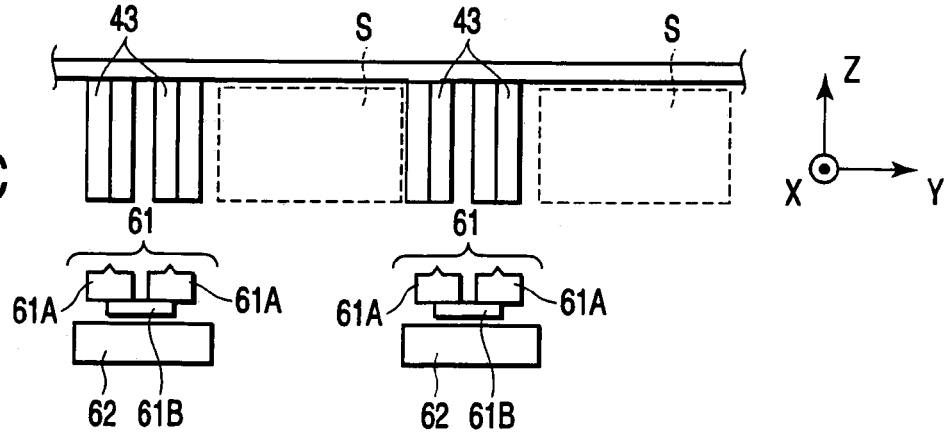
FIG. 11C is a schematic side view showing the arrangement of the maintenance section at the time of maintenance.

Then, the control section 90 gives a driving instruction to the slide mechanism 64B, thereby moving the transport direction guide frame 64. The movement is made along the Y-axis so that the maintenance units 61 may face the ink head columns 41. In other words, the maintenance units 61 are moved in such a manner that their position on the Y-axis practically coincide with the position of the ink head columns 41. As a result of the movement, each maintenance suction section 61A is placed in a position where it faces the corresponding ink head unit 43 as shown in FIG. 8. The maintenance ink pan 62 is provided below the maintenance suction section 61A. Therefore, the movement brings the maintenance ink pan 62 to the position on the Z-axis where the pan 62 faces the ink head column 41 as shown in FIG. 11C. In the embodiment, in each inkjet head 44, the direction in which ink is shot is practically along the Z-axis. At the same time, the nozzle plate 47 is set horizontally. Thus, arranging the maintenance ink pans 62 as described above enables ink shot or/and leaked from the inkjet head 44 to be caught, thereby preventing the contamination within the image recording apparatus 1 satisfactorily. When the nozzle plate 47 is not horizontal but inclines, the maintenance ink pan 62 put so as to face the nozzle plate 47 and directly under the nozzle plate 47 prevents more reliably the inside of the apparatus from being contaminated.

In this arrangement, each maintenance suction section 61A is placed in a position facing one end of the corresponding inkjet head 44 on the X-axis. More specifically, each maintenance suction section 61A is placed in a position facing more of the outside of the inkjet head 44 than the nozzles 47*a*. Therefore, with this arrangement, in each maintenance suction section 61A, the suction openings 61Aa do not face the nozzles 47*a* on the X-axis.

In this way, after the maintenance section positioning process is completed, a purge process is conducted.

[Purge Process]

Figure 12:
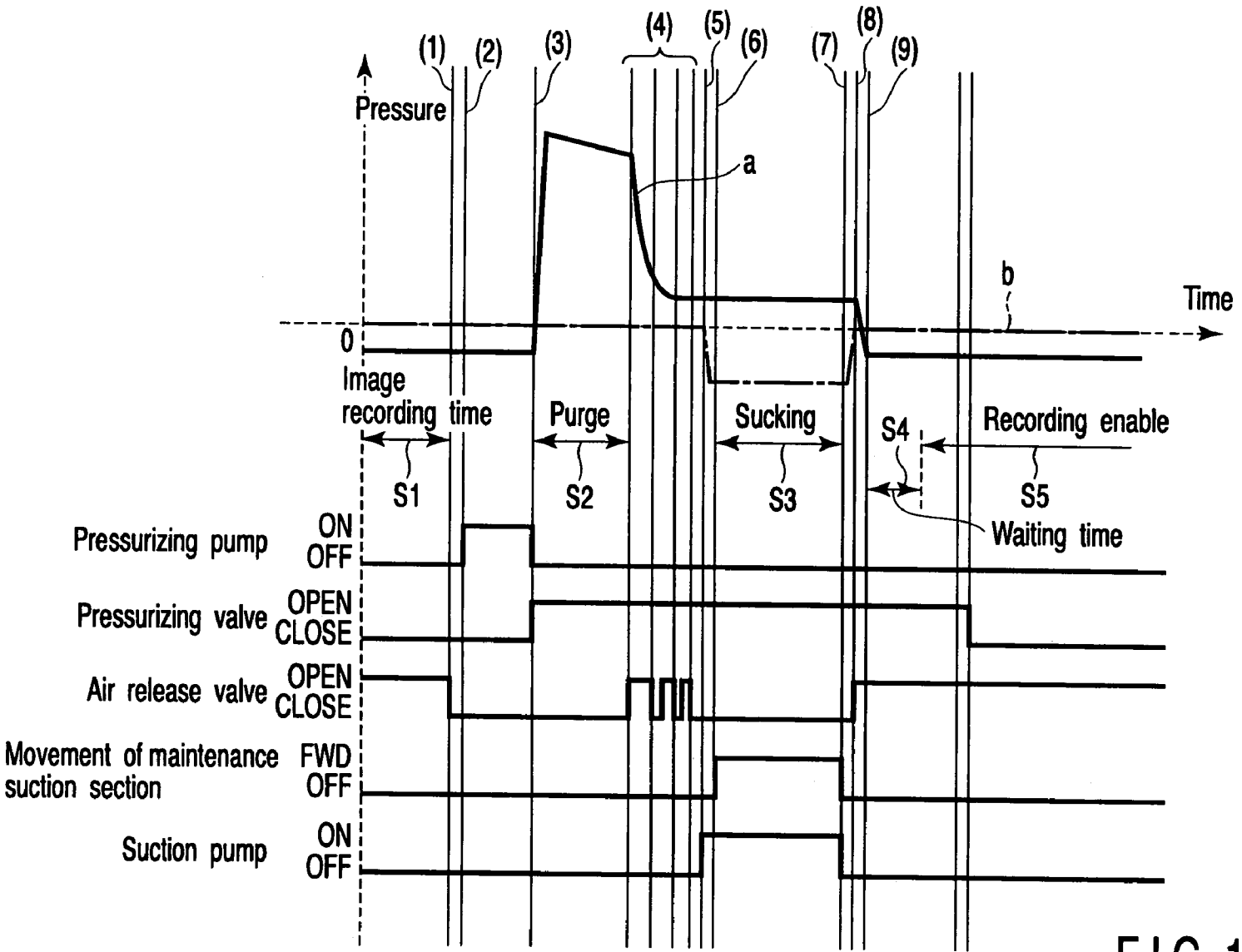
FIG. 12 schematically shows the operation of the valve and pump during maintenance.

The purge process will be explained by reference to FIGS. 12 and 13. FIG. 12 schematically shows the operation of the valve and pump during maintenance. FIG. 13 schematically shows ink at the inkjet head in each state in FIG. 12. In FIG. 12, line a indicates the pressure in the ink chamber 48*d* and line b represents the pressure applied to the maintenance suction section 61A.

Figure 13A:
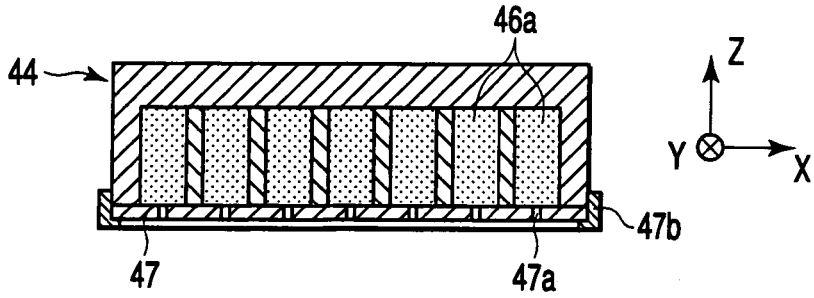
FIG. 13A schematically shows ink at the inkjet head in recording an image in FIG. 12, FIG. 13B schematically shows ink at the inkjet head during purging in FIG. 12, FIG. 13C schematically shows ink at the inkjet head before sucking in FIG. 12, FIG. 13D schematically shows ink at the inkjet head at the start of sucking in FIG. 12, FIG. 13E schematically shows ink at the inkjet head during sucking in FIG. 12, and FIG. 13F schematically shows ink at the inkjet head after the completion of sucking an image in FIG. 12.

In the purge process, the control section 90 provides driving control of the valve and pump in the procedure below. In the purge process, the control section 90 closes the air release valve 72*g* opened during image recording time S1 (see (1) in FIG. 12). Before the air release valve 72*g* is closed, a meniscus is formed at each inkjet head 44 as described above, which prevents ink from leaking from each nozzle 47*a* as shown in FIG. 13A. At this time, the pressurizing valve 72*e* is also closed. At the same time, neither the suction pump 66 nor the pressurizing pump 76 starts driving.

As described above, after the air release valve 72*g* in each color ink passage is closed, the control section 90 outputs a driving instruction to the pressurizing pump 76 (see (2) in FIG. 12). Receiving the instruction, the pressurizing pump 76 starts driving. Since the pressurizing valve 72*e* is closed, the air tank 75 is kept airtight. Therefore, the driving of the pressurizing pump 76 makes the pressure in the air tank positive. The pressure in the air tank 75 is monitored by the pressure sensor 75*b*.

Then, when the pressure sensor 75*b* has sensed that the pressure in the air tank 75 has reached a specific value (purge pressure), the pressurizing pump 76 is stopped and at the same time, the pressurizing valve 72*e* is opened (see (3) in FIG. 12). Opening the pressurizing valve 72*e* causes a positive pressure to be applied to the main ink tank 72. Since the air release valve 72*g* has been closed, the pressure is exerted on the ink filled in the main ink tank 72, with the result that ink is pressed out of the main ink tank 72 toward the distributor 71. The pressed-out ink is applied to the ink chamber 48*d* of each inkjet head 44 via the ink distributor 71. The pressure applied to each ink chamber 48*d* is applied to each piezoelectric groove 46*a*. Furthermore, the pressure in each piezoelectric groove 46*a* is applied to the corresponding nozzle 47*a*. Specifically, although the air tank 75 to nozzle 47*a* are composed of a plurality of members, they are connected to one another in a practically airtight manner, which enables the pressure in the air tank 75 to be applied to the nozzle 47*a*.

Figure 13B:
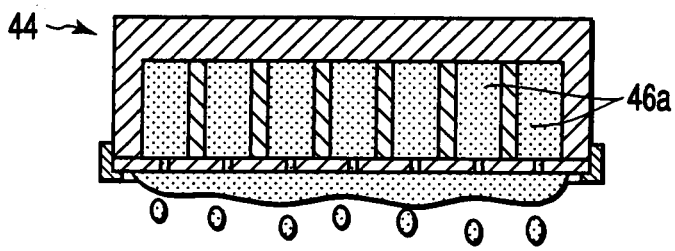
Figure 13C:
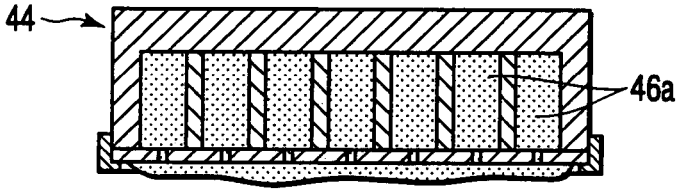

The purge pressure, that is, the pressure applied to the air tank 75, is set to a value at which ink can be discharged from each nozzle 47*a*. In other words, the purge pressure is set to a value at which the pressure applied to the nozzle 47*a* exceeds the surface tension of the meniscus in the nozzle 47*a* and ink drips from the nozzle plate 47. For example, the purge pressure is set to about 10 to 50 kilopascals (KPa). Since the purge pressure depends on the viscosity of ink and the materials constituting the nozzle 47*a* or others, it is changed arbitrarily. Applying the purge pressure to each nozzle 47*a* causes ink to be discharged from each nozzle 47*a* all at once as shown in FIG. 13B.

When ink is discharged as described above, foreign matter, such as air bubbles and dust mixed in the ink chamber 48*d*, is discharged together with the ink from the nozzle 47*a*.

The discharging of the ink is effected during purge S2 in FIG. 12. The period of purge S2 is measured by the timer of the control section 90. After a specific length of time has elapsed, the pressure applied to the ink chamber 46*d* is lowered to a specific value (suction positive pressure), which terminates the purge period. The specific length of time is selected from, for example, the range of about 0.3 to about 20 seconds, more preferably, the range of about 0.5 second to about 5 seconds.

To lower the pressure in each ink chamber 48*d*, the air release valve 72*g* is opened (see (4) in FIG. 12). Opening the air release valve 72*g* causes the pressure in the main ink tank 72 to decrease, which allows the pressure exerted on each ink chamber 48*d* to decrease. The suction positive pressure is set to a pressure at which ink crosses the nozzle 47*a* and leaks to the nozzle plate 47, but does not drip from the nozzle plate 47. The suction positive pressure is, for example, about 1.2 KPa. The suction positive pressure is changed arbitrarily as is the purge pressure.

When the pressure in the main ink tank 72 has dropped practically to the suction positive pressure, the air release valve 72*g* is closed. When an attempt is made to lower the pressure in the main ink tank to the suction positive pressure by only one open and close operation of the air release valve 72*g*, the pressure in the main ink tank 72 changes rapidly. Therefore, when the air release valve is closed, the pressure in each ink chamber 48*d* changes rapidly. In this case, when the air release valve 72*g* is closed, a large undershoot occurs according to a rapid change in the pressure. In other words, when the air release valve 72*g* is closed in response to a rapid change in the pressure, the pressure temporarily takes a value lower than the pressure at the time when the valve is closed. The amount of deflection of the pressure becomes larger as a change in the pressure is larger. Therefore, when the pressure is changed rapidly as described above, there is a possibility that the pressure in the ink chamber 48*d* will become negative temporarily due to the undershoot. When the pressure become negative temporarily as described above, the fluid level of the ink moves between the nozzle 47*a* and the piezoelectric groove 46*a*, which can pull air into the piezoelectric groove 46*a*.

Therefore, after the purge S2 is completed, the control section 90 of the embodiment opens and closes the air release valve 72*g* intermittently a plurality of times until the pressure has dropped to the suction positive pressure (see (4) in FIG. 12). In this control, even when the pressure is lowered in a short time, a change in the pressure becomes smaller in one open and close operation, which makes the pressure change at the time of the opening and closing of the air release valve 72*g* smaller and prevents the pressure in the ink chamber 48*d* from becoming negative.

As described above, after the pressure in the ink chamber 48*d* drops to the suction positive pressure and becomes stable, a sucking process is carried out.

[Sucking Process]

In the sucking process, the maintenance suction section 61A sucks in ink adhering to the inkjet head 44. As explained in the maintenance section positioning process, to effect sucking, the suction section 61A is aligned with the inkjet head 44 and pressed against the head 44.

Alignment in height is performed by raising the platen section 30 and pushing up the maintenance suction section 61A from below. After the platen section 30 is raised to a specific position where the maintenance suction section 61A can suck, the movement of the platen section is stopped.

When the maintenance suction section 61A presses against the inkjet head 44, the guide projecting part 61Ab is inserted into the guide groove 44*e* in the inkjet head 44 and engaged therewith. As a result, in the maintenance suction section 61A, the direction of arrangement of the suction opening columns 61Ae is aligned with the direction of arrangement of the nozzles 47*a*.

When the alignment of the maintenance suction section 61A with the inkjet head 44 is completed, the suction pump 66 starts driving (see (5) in FIG. 12). By this driving, the maintenance suction section 61A starts to suck. In the embodiment, the suction applied by the suction pump 66 is set so that the maintenance suction section 61A can suck at a negative pressure of −3 KPa to −5 Kpa.

Figure 13D:
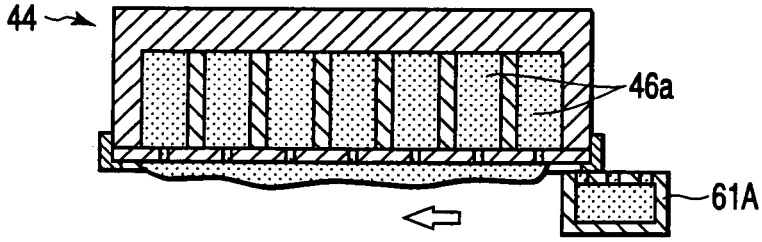

As described above, in the maintenance section positioning process, the alignment of the inkjet head 44 with the maintenance suction section 61A and the start of the driving of the suction pump 66 are performed in an area where the nozzle 47*a* is not provided (see FIG. 13D). Therefore, in the alignment, ink in the position facing the nozzle 47*a* is prevented from being sucked under still unstable negative pressure.

After the alignment is completed and the negative pressure produced by the suction pump 66 has reached a specific value and become stable, the maintenance suction section 61A starts the sucking S3. In this sucking, the control section 90 gives a driving instruction to the suction section frame driving mechanism 63*a* of the maintenance suction section 61A. According to the driving instruction, the suction section frame driving mechanism 63*a* starts to move the maintenance suction section frame 63 together with the maintenance suction section 61A (see (6) in FIG. 12). The suction section frame driving mechanism 63*a* moves the maintenance suction section 61A across the inkjet head 44 in the direction of arrangement of the nozzles 47*a*. In other words, in the embodiment, the maintenance suction section 61A is moved from one end of the inkjet head 44 to the other end along the X-axis. The maintenance suction section 61A is guided along the guide groove 44*e* and is moved reliably in the direction of arrangement of the nozzles 47*a*. During the movement, the maintenance suction section 61A can keep a constant distance from the nozzle 47*a* to slide over the nozzle plate cover 47*b*.

The recording-medium-side face of the inkjet head 44 is covered with the nozzle plate cover 47*b*. While the suction section head facing side 61Ad of the maintenance suction section 61A is pressing against the nozzle plate cover 47*b* and the wiper blade 61Ac is pressing against the nozzle forming face 47*d*, the maintenance suction section 61A moves in the X-axis direction. As a result, the suction section head facing side 61Ad of the maintenance suction section 61A is separated from the nozzle forming face 47*d* by the thickness of the nozzle plate cover 47*b* on the Z-axis.

When pressing against the nozzle forming face 47*d* as described above, the wiper blade 61Ac is positioned in front of the suction opening column 61Ae in the direction of movement during suction.

Figure 13E:
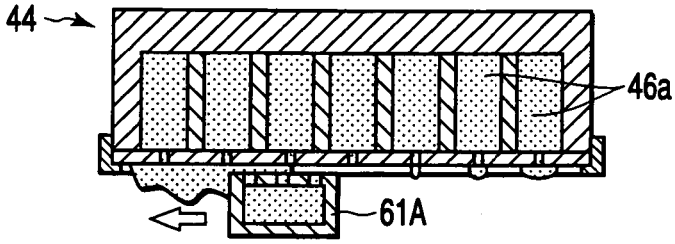

The maintenance suction section 61A moves along the X-axis in the sucking S3, thereby sucking in ink (see FIG. 13E). During this sucking 83, the wiper blade 61Ac wipes the nozzle forming face 47*d*. Then, the suction opening column 61Ae sucks in ink near the nozzle column of the inkjet head 44. In the meantime, the suction positive pressure is exerted on the ink chamber 48*d* and nozzle 47*a* as described above. As a result, an ink pool is formed on the nozzle forming face 47 47*d* and nozzle plate cover 47*b* (see FIG. 13D). This ink pool is made of the ink resulting from a purge and the ink leaked from the nozzle under the suction positive pressure.

The maintenance suction section 61A sucks in the ink in the ink pool. That is, the maintenance suction section does not suck in the ink from the inside of the nozzle 47*a* where a meniscus is formed as if it pulled off the ink forcibly. In other words, the maintenance suction section 61A of the embodiment sucks in the ink in the ink pool outside the nozzle. This prevents the fluid level of ink from moving unstably between the nozzle 47*a* and the ink chamber 48*d* during the suction. That is, the maintenance suction section 61A of the embodiment prevents air from being pulled into the ink chamber 48*d* as a result of the movement of the fluid level of ink when the ink is sucked in.

The nozzle plate 47 and nozzle plate cover 47*b* are exposed to ink until the ink is sucked in by the suction section 61A. This allows dust or the like to float to the surface and makes it easier to be sucked in. The maintenance suction section 61A then sucks in the dust floating to the surface together with ink, thereby cleaning the nozzle plate 47 reliably.

During suction, the suction openings 61A are arranged all over the nozzle plate cover 47*b* along the Y-axis, or in the direction perpendicular to the direction of movement. Therefore, the maintenance suction section 61A moves along the X-axis, thereby sucking in all of the ink pool on the inkjet head 44.

The inlet hole 61Ah is set at a position within the suction opening 61Aa at which the hole does not face the nozzle 47*a*. As compared with a case where the inlet hole 61Ah faces the nozzle 47*a*, this setting alleviates the direct effect of the suction applied by the inlet hole 61Ah on the nozzle 47*a* and allows the ink pool to be sucked in.

Figure 14:
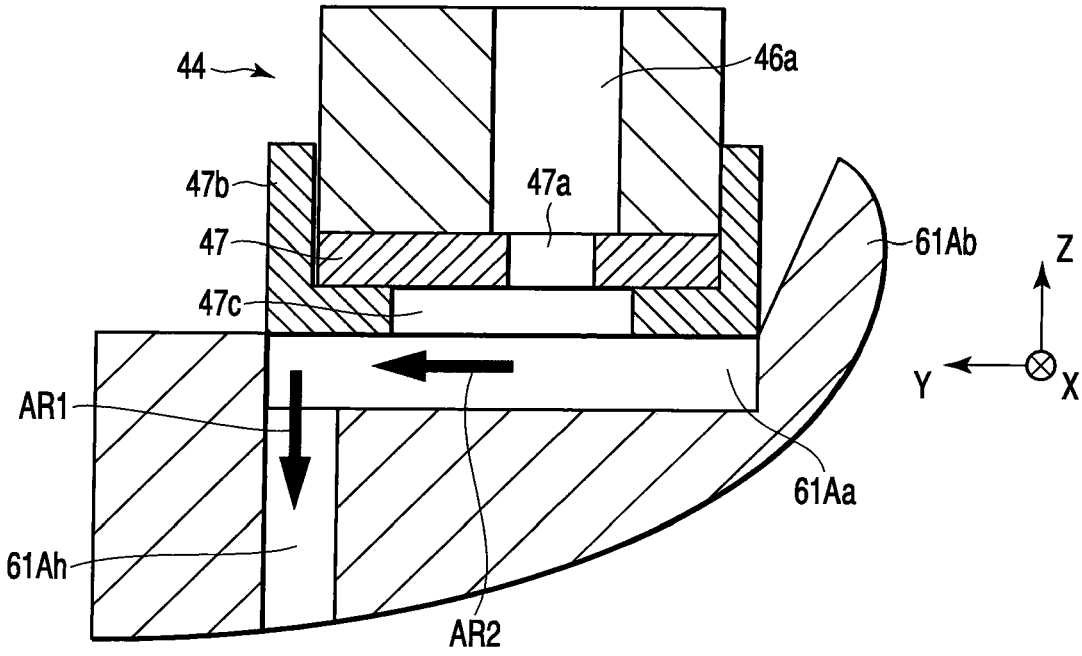
FIG. 14 is an enlarged sectional view of the maintenance suction section.

Furthermore, as shown in FIG. 14, the direction (arrow AR1 in FIG. 14) in which suction is applied through the inlet hole 61Ah is along the Z-axis, the same direction in which the nozzle 47*a* extends. In the suction opening 61Aa, the direction may be changed to a direction along the Y-axis as shown by arrow AR2. Therefore, the negative pressure generated in the inlet hole 61Ah, which makes laminar flow AR2, suppresses the suction having a greater effect directly on the nozzle 47*a*.

The suction opening column 61Ae is composed of an arrangement of three suction openings 61Aa. Therefore, as the maintenance suction section 61A moves, the same part of the inkjet head 44 is sucked in by a plurality of suction openings 61Aa. Thus, the ink in the ink pool can be sucked in more reliably. Furthermore, since the suction openings 61Aa are spaced apart in the direction in which they are arranged, the suction opening column 61Ae applies suction to the part to be sucked in of the inkjet head 44 intermittently a plurality of times. In other words, the maintenance suction section 61A causes a change in the negative pressure a plurality of times at the part to be sucked in, without opening and closing the valve or driving control of the suction pump 66. When the negative pressure changes a plurality of times, even highly adhesive ink, such as ink adhering to the less water-repellent nozzle plate cover 47*b* than the nozzle plate, is sucked in. Therefore, although having a simple configuration, the maintenance suction section 61A sucks in ink more reliably by a change in the negative pressure.

In addition, the wiper blade 61Ac moves in such a manner that the column 61Ae faces the nozzle plate 47, thereby scraping the ink adhering to the nozzle plate 47.

In the sucking S3, the suction positive pressure is always applied to the ink chamber 48*d*. Thus, as shown in FIG. 13*e*, ink is also leaking from each nozzle 47*a* under the suction positive pressure after the suction section 61A has passed. However, since the suction positive pressure is as low as about 1.2 KPa, the amount of ink leaked is small.

After all of each inkjet head 44 has been sucked in, the suction section frame driving mechanism 63*a* ends the driving from one end of the inkjet head 44 to the other end (see (7) in FIG. 12). At this time, the suction pump 66 also ends the driving. These are done under the control of the control section 90.

At the same time, the control section 90 lowers the platen section 30, thereby separating the maintenance section 60 from the inkjet head 44 again as shown in FIG. 11C. After separating them, the control section 90 drives the suction section frame driving mechanism 63*a*, thereby returning the maintenance suction section frame 63 again to the position before the maintenance process.

Figure 13F:
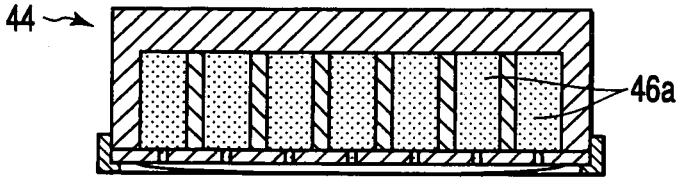

Then, after the suction pump 66 has ended the driving, the air release valve 72*g* is opened (see (8) in FIG. 12) before ink leaking under the suction positive pressure crosses the nozzle plate 47 and comes into contact with the nozzle plate cover 47*b*. As a result, a specific water head pressure (the negative pressure) is applied to the ink chamber 48*d* again. At this time, an ink pool is formed on the nozzle plate as shown in FIG. 13F. The ink pool is not in contact with the nozzle plate cover 47*b*. Since the nozzle plate 47 is covered with water-repellent coating, the ink is sucked into the nozzle 47*a* under the water head pressure at the formation of a meniscus. Since the nozzle plate surface after the sucking is clean, even when the ink on the nozzle plate returns to the nozzle 47*a*, it does not contaminate the ink in the nozzle 47*a*.

After a waiting time T after the pressure in the ink chamber 48*d* reaches the specific negative pressure under the water head pressure (see S4 beginning at (9) in FIG. 12), the meniscus becomes stable and the inkjet head 44 returns to the image recording enable state S5 (see FIG. 12) as in the middle of FIG. 13A, which completes the sucking process.

In this way, the maintenance operation is completed.

In the configuration, the maintenance suction section 61A sucks in ink, when the ink chamber 48*d* is under the suction positive pressure. This allows the maintenance suction section 61A to suck in the ink in the ink pool outside the nozzle 47*a*. Therefore, the image recording apparatus 1 can clean the face of the inkjet head 44 facing the recording medium, while preventing air from being pulled in as a result of the movement of the fluid level of ink.

Before causing the maintenance suction section to suck in ink, the control section 90 controls each valve and pump so as to make the ink chamber 48*d* have the suction positive pressure. Since the ink pool has been formed at the time of suction, the image recording apparatus 1 prevents air from being pulled in more reliably.

Furthermore, after the sucking process, the control section 90 controls the air release valve 72*g* and pressurizing valve 72*e* so as to make the ink chamber 48*d* have the suction positive pressure. As a result, after the sucking process, an ink pool is formed in the area of the inkjet head 44 facing the recording medium to such an extent that the ink does not drip from the area.

In addition, the control section 90 sets the purge pressure higher than the suction pressure. The control section 90 may set the purge pressure and the suction pressure to the same value. However, when the purge pressure is set higher than the suction pressure, more ink can be caused to flow through the nozzle before suction. Therefore, when there is dust in the ink chamber 48*d*, the dust is discharged together with the ink more reliably than when less ink flows.

Moreover, when lowering the pressure in the ink chamber 48*d* to the suction positive pressure, the control section 90 opens and closes the air release valve 72*g* a plurality of times, thereby lowering the pressure stepwise. This makes it possible to reduce a variation in the pressure caused by undershoot occurring at the time of the closing of the air release valve 72*g*. As a result, while lowering the pressure in a short time, the image recording apparatus 1 of the embodiment prevents the pressure in the ink chamber from becoming negative due to the undershoot. This suppresses a fluctuation in the fluid level of ink due to the undershoot, thereby preventing air from pulled into the ink chamber.

While in the embodiment, the occurrence of undershoot is prevented by opening and closing the air release valve a plurality of times, the same effect can be produced by changing the degree of opening of the air release valve.

Figure 15:
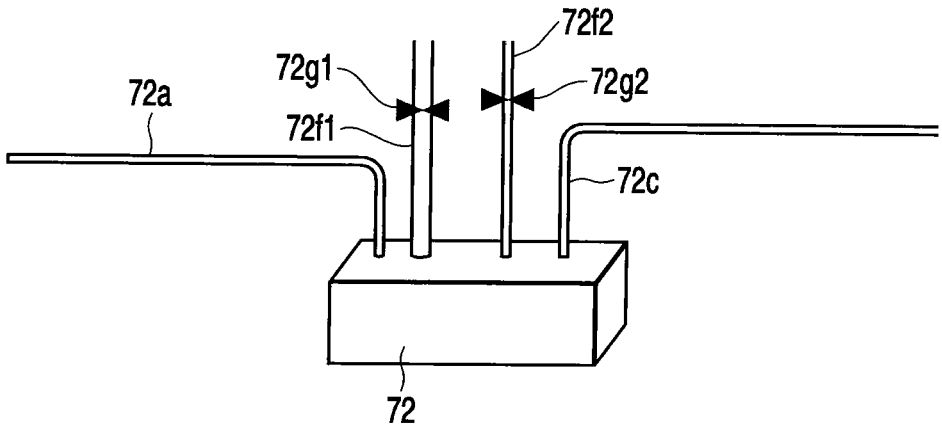
FIG. 15 schematically shows a modification of the air release valve and air release tube.

In addition, a plurality of air release tubes 72*f* and a plurality of air release valves 72*g* may be provided in the main ink tank 72, thereby controlling the opening the air release tubes. For example, as shown in FIG. 15, a large-diameter air release tube 72*f*1 and a smaller-diameter air release tube 72*f*2 that has a diameter that is smaller than the diameter of the air release tube 72*f*1 are provided in the main ink tank 72. The air release valve 72*g*1 is provided in the air release tube 72*f*1 and the air release valve 72*g*2 is provided in the air release tube 72*f*2. The operations and functions of the air release tubes 72*f*1, 72*f*2 and the air release valves 72*g*1, 72*g*2 are essentially the same as those of the air release tube 72*f* and air release valve 72*g*. When lowering the pressure in the ink chamber 48*d* to the suction positive pressure, these air release valves 71*g*1, 72*g*2 are controlled by the control section 90 as described below. Besides lowering the pressure, the control section 90 controls each valve and each pump as explained in FIG. 12.

Figure 16:
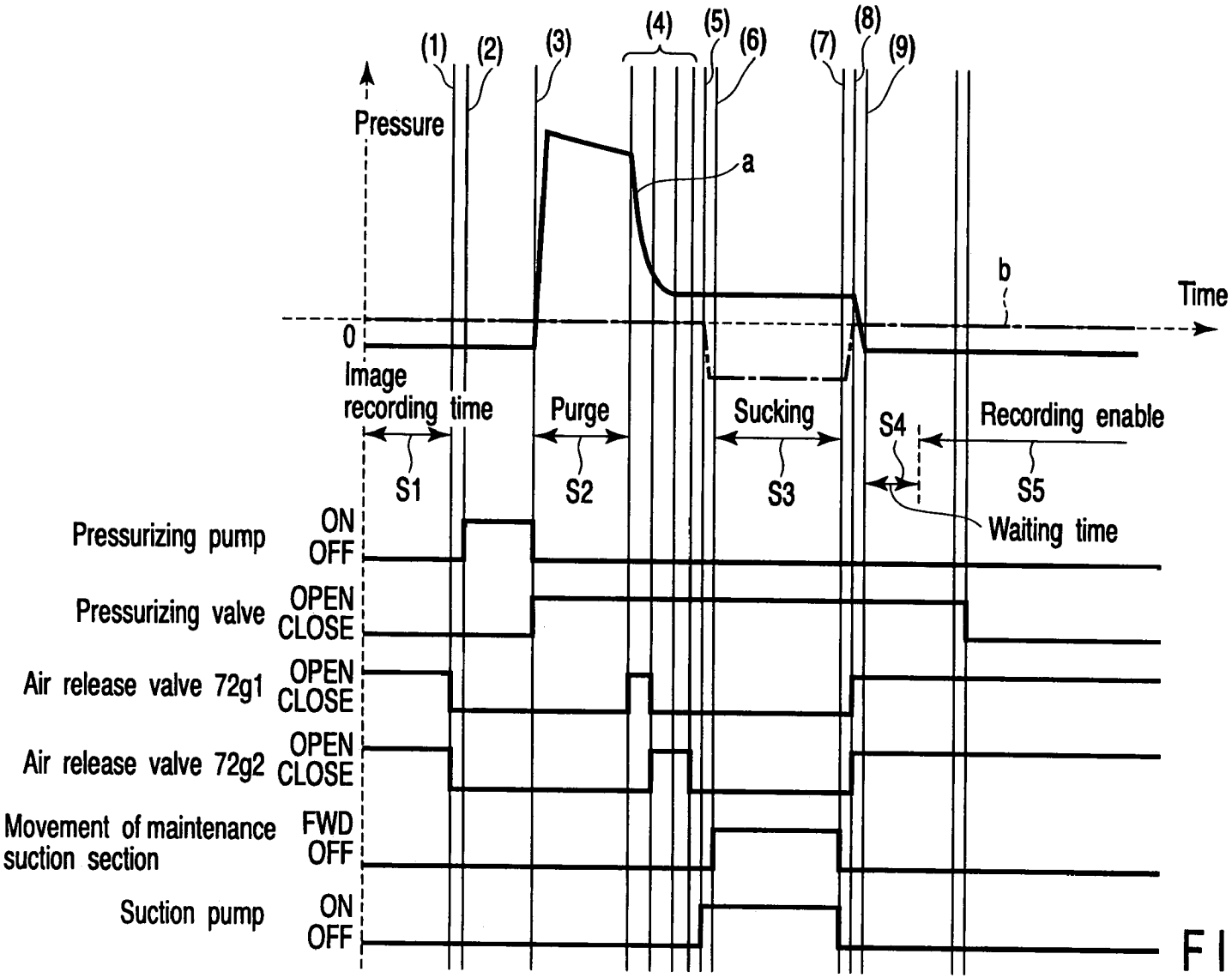
FIG. 16 schematically shows a modification of the operation of the valve and pump during maintenance.

The control of the air release valves 72*g*1, 72*g*2 is shown in FIG. 16. As shown in (4) in FIG. 16, after the purge S2 is completed, the air release valve 72*g*1 of the large-diameter air release tube 72*f*1 is opened for a specific time, thereby lowering the pressure all at once. Although how much the pressure is lowered is arbitrary, the amount of pressure drop is set to a value at which the pressure will not become negative even if the pressure has changed rapidly due to undershoot caused by the closing of the air release valve 72*g*1.

The air release valve 72*g*1 is closed after being opened for a specific time. As the valve 72*g*1 is closed, the air release valve 72*g*2 is opened. The air release valve 72*g*2 is opened until the pressure in the ink chamber 48*d* has reached the pressure set to effect sucking. In general, when the amount of pressure drop per unit time is small, the amount of deflection of the pressure caused by undershoot is small. Therefore, the diameter of the air release tube 72*f*2 is set to a value at which the pressure in the ink chamber 48*d* will not become negative at the time of the closing of the valve, even when the air release valve 72*g*2 is opened for the period.

With the above configuration, while the pressure is being lowering by the opening of the large-diameter air release tube 72*f*1, the opening of the small-diameter air release tube 72*f*2 prevents a rapid change in the pressure resulting from undershoot.

While in the above modification, two air release tubes have been used, three or more air release tubes may be used. All of the air release valves may have the same diameter and the opening and closing of the air release valves may be controlled, thereby suppressing undershoot. In this case, too, the pressure can be lowered in a short time, while suppressing undershoot.

In addition, the inlet hole 61Ah is set in a position in the suction opening 61Aa so that it may not face the nozzle 47*a* during suction. In other words, the inlet hole 61Ah faces an area other than the nozzle 47*a* of the inkjet head 44. This structure alleviates the direct effect of the suction applied by the inlet hole 61Ah on the nozzle 47*a* and allows the ink pool to be sucked in. Therefore, the image recording apparatus 1 sucks in surplus ink over a wide area near the nozzle 47*a*, while preventing the ink in the nozzle 47*a* from being pulled off and sucked in.

Figure 17:
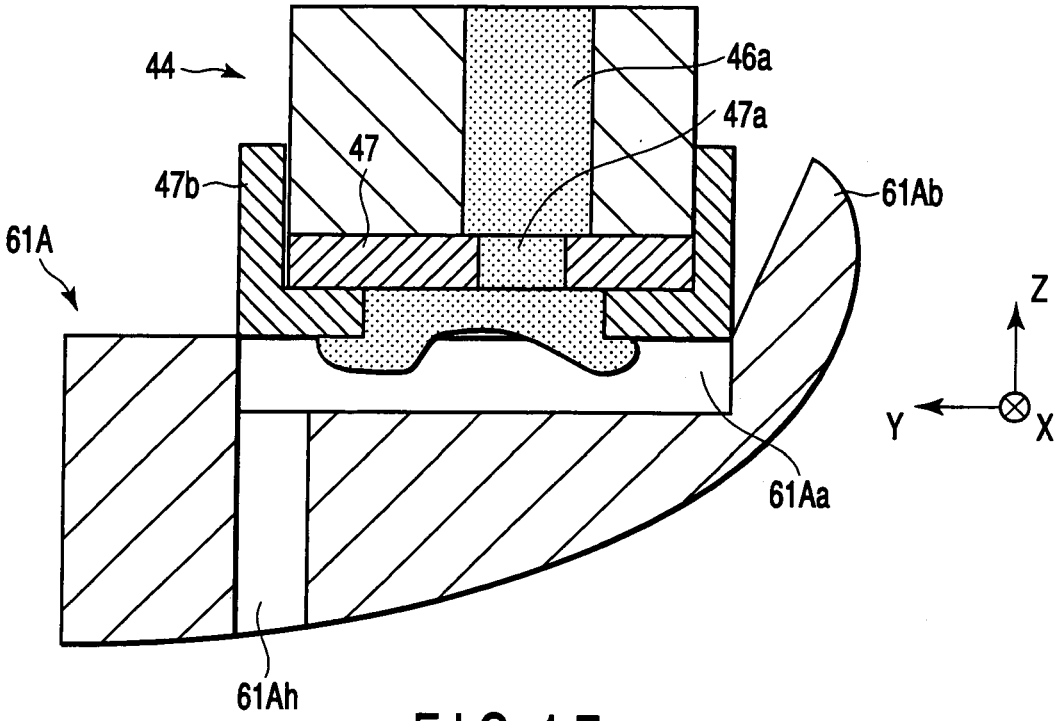
FIG. 17 is an enlarged sectional view of a modification of the maintenance suction section.

As shown in FIG. 17, the inlet hole 61Ah of the embodiment is positioned at the boundary between the nozzle plate 47 and the nozzle plate cover 47*b*. In general, fluid gathers on the less water-repellent one of two members differing in water-repellent finish. Therefore, fluid is liable to gather at the boundary between two members differing in water-repellent finish. Accordingly, at the boundary between the nozzle forming face 47*d* and the nozzle plate cover 47*b*, ink is liable to gather. When the inlet hole 61Ah is positioned at the boundary as described above, this arrangement applies efficient suction to the area carrying more ink, thereby sucking in the ink more reliably.

If strong suction is not applied to the nozzle 47*a*, the inlet hole 61Ah may be made in a position facing the nozzle 47*a*. In the maintenance suction section 61A in FIG. 18, a smaller-diameter inlet hole 61Ah1 having a diameter that is smaller than a diameter of inlet hole 61Ah is made. More specifically, the diameter of the inlet hole 61Ah1 is set to a value at which suction to suck in only the ink outside the nozzle 47*a* is applied at the time of sucking.

Since the inlet holes 61Ah, 61Ah1 are arranged over a wide area, ink is sucked in more reliably.

Figure 18:
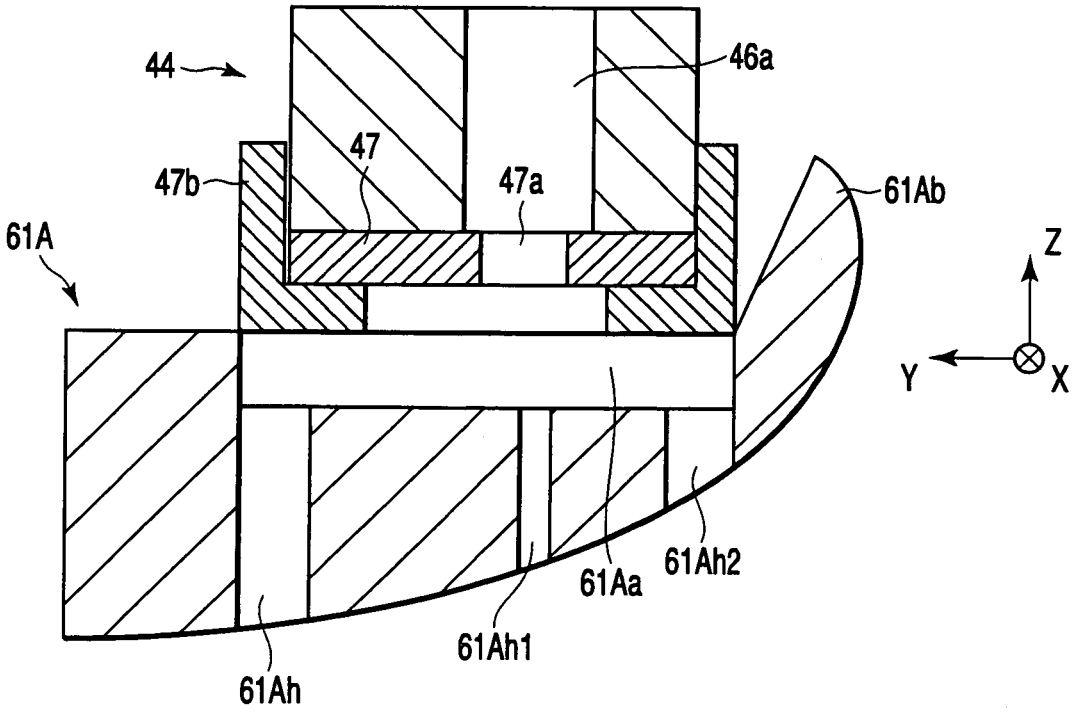
FIG. 18 is an enlarged sectional view of another modification of the maintenance suction section.

Furthermore, in the maintenance suction section 61A of FIG. 18, inlet holes 61Ah2 are further provided at both ends of the nozzle plate cover 47*b* on the Y-axis. This enables the maintenance suction section 61A to suck in ink more reliably. As described above, the number of inlet holes 61Ah and their arrangement are arbitrary. However, when the large-diameter inlet hole 61Ah is used, it is desirable that it should be provided in a position not facing the nozzle 47*a*.

The suction opening section 61Aa of the embodiment faces the nozzle plate 47 and the nozzle plate cover 47*b*. Therefore, the maintenance suction section 61A of the embodiment sucks in ink on not only the nozzle plate 47 but also other areas.

Figure 19:
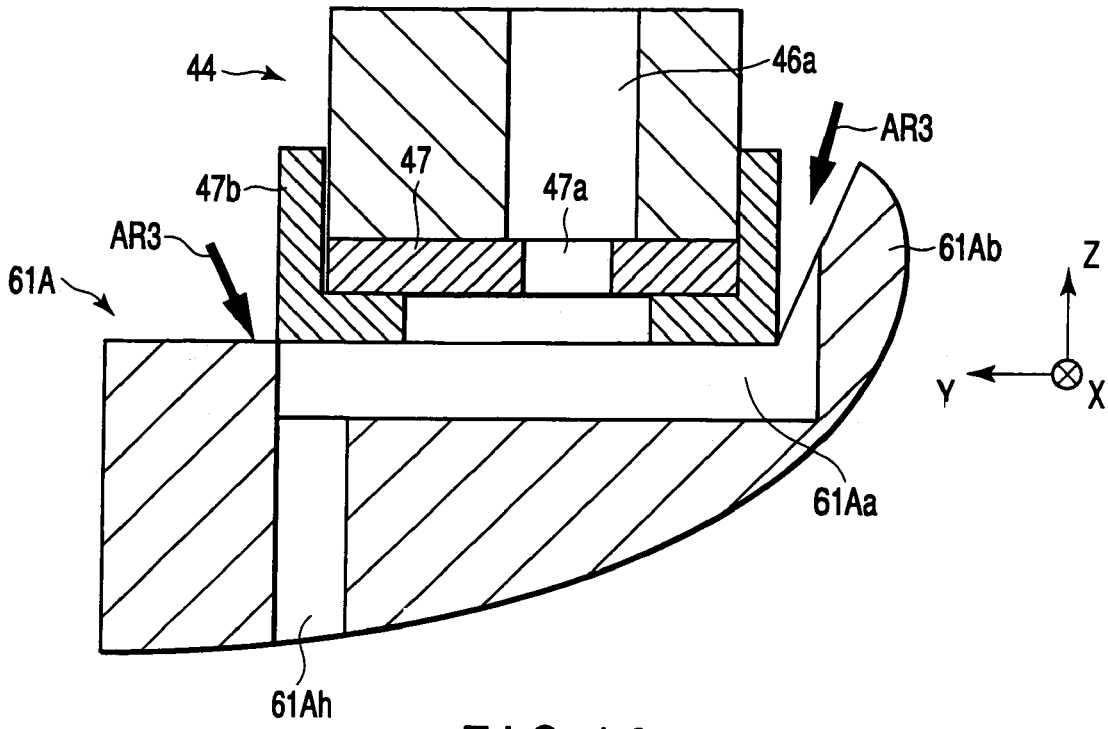
FIG. 19 is an enlarged sectional view of still another modification of the maintenance suction section.

In the embodiment, as shown in FIG. 19, the suction opening 61Aa may be extended to an area beyond the nozzle plate cover 47*b* on the Y-axis perpendicular to the direction in which the nozzles are arranged. Therefore, the suction opening 61Aa has an area not facing the nozzle plate cover 47*b*. The inlet hole 61Ah sucks in outside air from the area not facing the nozzle plate cover at the time of suction as shown by arrow AR3. This causes active convection in the suction opening 61Aa during suction, thereby sucking in ink more reliably. If the maintenance suction section 61A has a desired function of cleaning the inkjet head 44, it may cause the inlet hole 61Ah to suck in ink directly without having the suction opening 61Aa.

Figure 20:
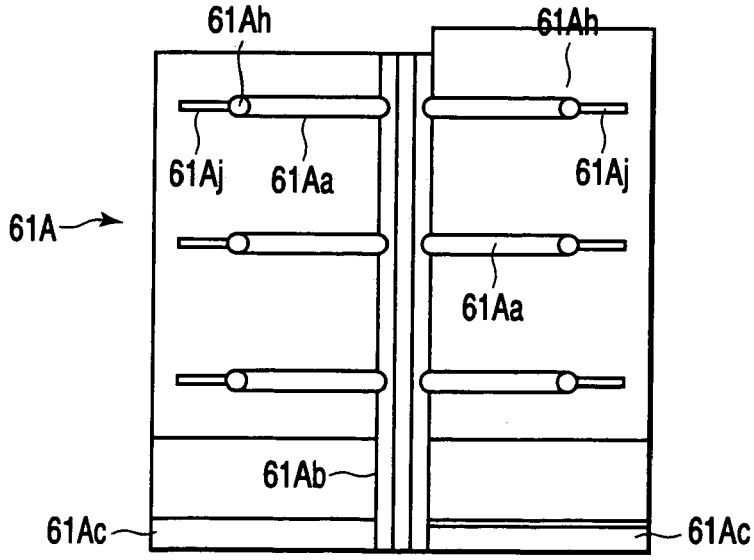
FIG. 20 is a top view of the modification of the maintenance suction section in FIG. 19.

The suction opening 61Aa extending to an area beyond the nozzle plate cover 47*b* of FIG. 19 may be made narrower in the area outside the inlet hole 61Ah with respect to the position facing the nozzle 47*a* on the Y-axis as shown in FIG. 20. In other words, the suction opening 61Aa has an end far away from the inlet hole 61Ah (the end on the guide projecting section 61Ab side) and an end close to the inlet 61Ah (the end outside the maintenance suction section 61A), with the width of the end close to the inlet being narrower than that of the end far away from the inlet. This allows the sucking forces to be distributed equally to both ends. Therefore, the maintenance suction section 61A configured as described above can suck in ink uniformly all over the inkjet head 44.

Figure 21:
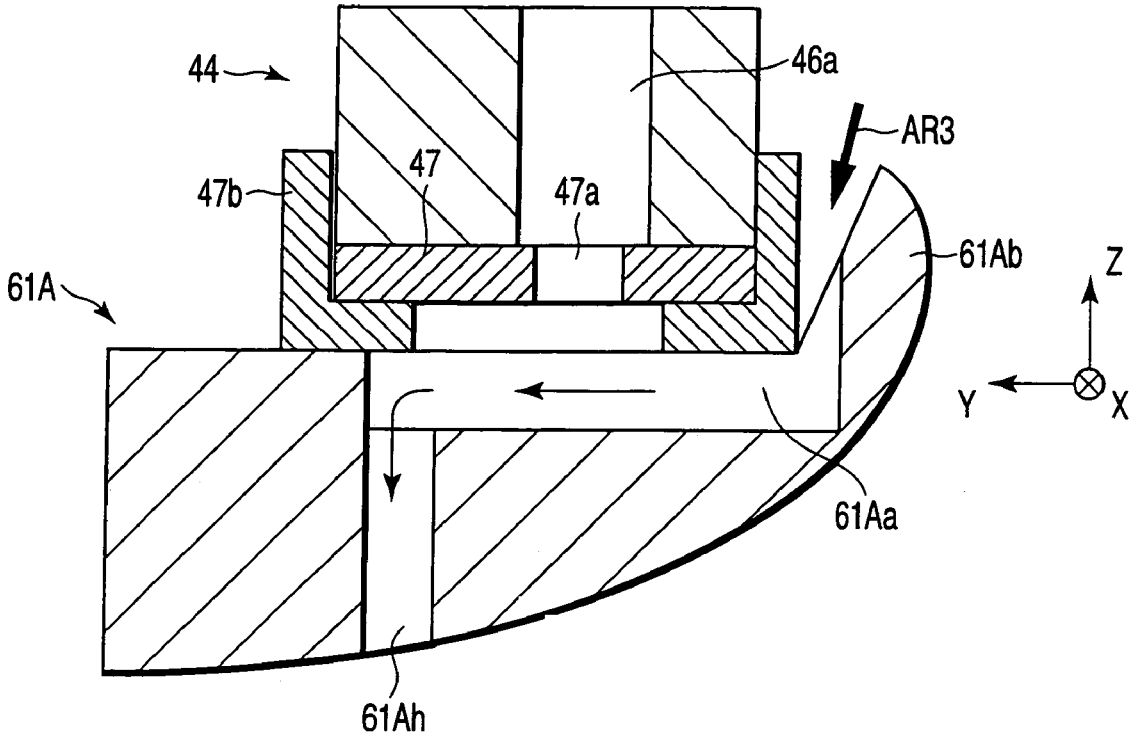
FIG. 21 is an enlarged sectional view of still another modification of the maintenance suction section.
Figure 22:
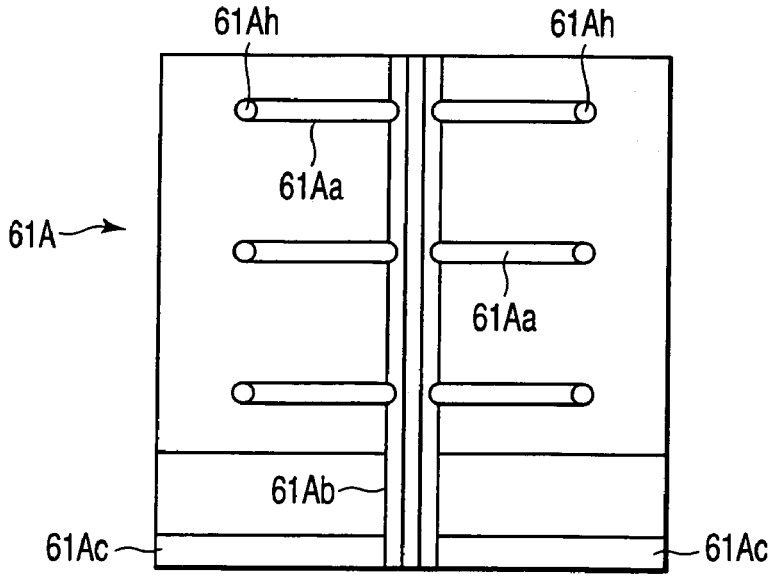
FIG. 22 is a top view of the modification of the maintenance suction section in FIG. 21.
Figure 23:
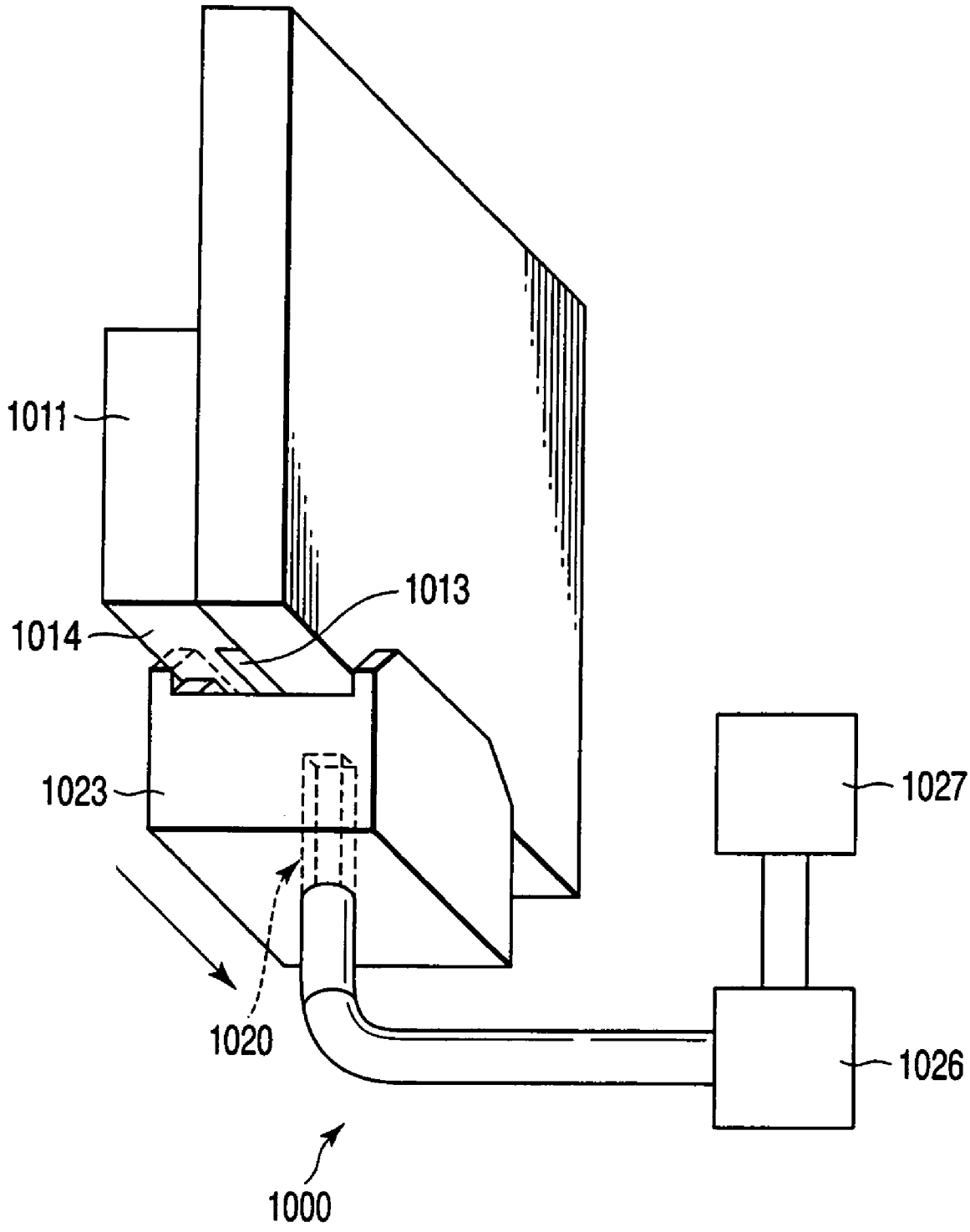
FIG. 23 (PRIOR ART)
FIG. 23 is a schematic perspective view of a conventional maintenance unit.
Figure 24:
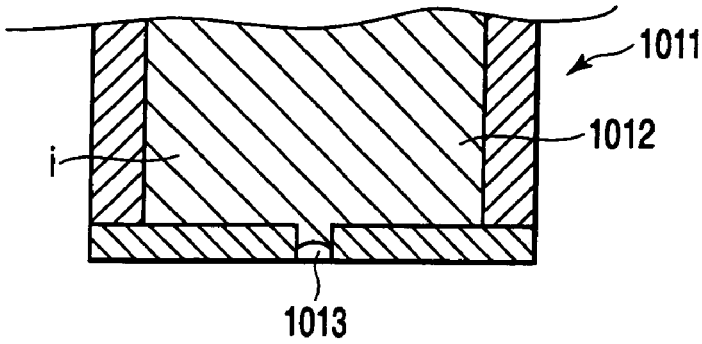
FIG. 24 (PRIOR ART)
FIG. 24 is a schematic sectional view showing the state of ink under negative pressure in a conventional image recording apparatus.
Figure 25:
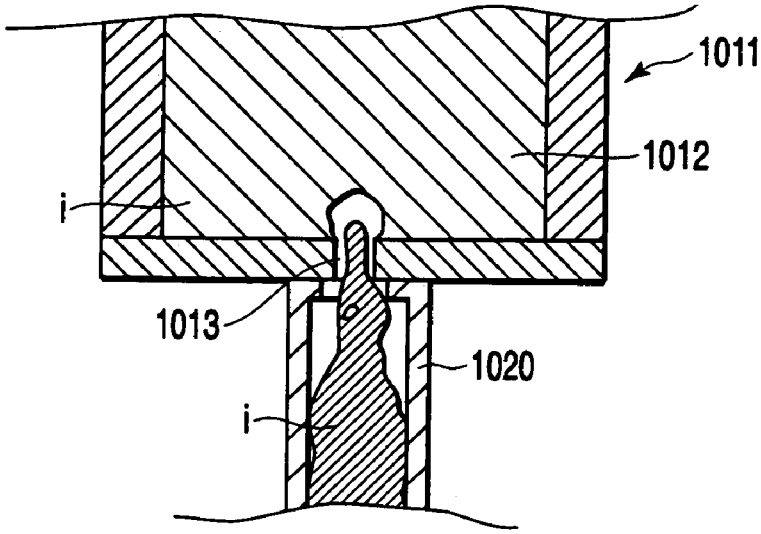
FIG. 25 (PRIOR ART)
FIG. 25 is a schematic sectional view showing the state of ink when the conventional maintenance unit applies suction.

As shown in FIGS. 21 and 22, it is desirable that 61Aj of FIG. 20 should be eliminated and air AR3 should be allowed to enter only at the end far away from the inlet hole 61Ah (the side of the suction opening 61Aa adjacent to the guide projecting section 61Ab). Since the unidirectional air flow produces laminar flow at the part facing the nozzle 47*a*, ink is sucked in from the nozzle 47*a* without being pulled off.

The maintenance suction section 61A of the embodiment is controlled so as to move at a constant speed during suction. This enables the maintenance suction section 61A to suck in ink from each nozzle for the same time, which applies uniform suction to all of the inkjet head 44 as compared with a case where the moving speed changes. The suction pump 66 is driven before the movement is started, which enables the suction section 61A to move after the pressure becomes stable.

In addition, the maintenance suction section 61A can be aligned with the inkjet head 44 in the area where no nozzle is provided. This prevents the nozzle 47*a* from being exposed to suction even when the suction pump 66 is driven during alignment. Therefore, the maintenance suction section 61A applies suction to each nozzle 47*a* only when moving in a sucking operation. Thus, the maintenance suction section 61A can apply uniform suction to the entire inkjet head 44.

Furthermore, the maintenance suction section 61A has a plurality of suction openings 61Aa in the direction in which the nozzles 47*a* are arranged. The maintenance suction section 61A applies a negative pressure intermittently to the parts to be sucked in of the inkjet head 44, thereby sucking in the unnecessary ink more reliably. If the maintenance suction section 61A has a desired function of cleaning the inkjet head 44, it may have only one suction opening 61Aa.

The maintenance suction section 61A has a guide projecting section 61Ab serving as an engaging part inserted in the guide groove 44*e* in the inkjet head 44. This enables the maintenance suction section 61A to be aligned with the inkjet head 44 securely.

Furthermore, the maintenance suction section 61A has the wiper blade 61Ac serving as wiping means for wiping ink on the inkjet head 44. Using the blade, the maintenance suction section 61A cleans the nozzle forming face 47*d* reliably. The suction section 61A cleans at least the nozzle plate 47*d* including the nozzle 46*a*.

If the maintenance suction section 61A has a desired function of cleaning the inkjet head 44, the wiper blade 61Ac may be eliminated.

While in the embodiment, only one suction opening 61Aa is provided for one inlet hole 61Ah, more than one suction opening 61Aa may be provided for one inlet hole 61Ah. While in the embodiment, the suction opening 61Aa is provided so as to run straight along the Y-axis, its path and shape may be changed arbitrarily. For example, to widen the suction area determined by the suction opening 61Aa, the suction opening 61Aa may be snaked.

Furthermore, while in the embodiment, all of the maintenance suction sections 61A move simultaneously as the maintenance suction section frame 63 moves, an independent driving mechanism may be provided for each maintenance suction section 61A to enable independent movement. In addition, the maintenance suction sections may be moved in units of a suction opening column 61Ae. Moreover, for the suction opening column 61Ae to retreat from the position facing the inkjet head 44 at the time of purge, the maintenance ink pan 62 and the suction opening column 61Ae may be driven independently.

While several embodiments have been explained concretely by reference to the drawings, the present embodiment is not limited to the above embodiments and may be practiced or embodied in still other ways without departing from the spirit or essential character thereof.

According to the present invention, there is provided an image recording apparatus with a maintenance mechanism capable of preventing air from being pulled into the ink chamber.

What is claimed is:

1. An image recording apparatus comprising: an inkjet head which includes: (i) a nozzle plate where a plurality of nozzles that shoot ink are arranged in a column, and (ii) an ink chamber which retains ink and communicates with said plurality of nozzles, wherein an area of the inkjet head that is positioned adjacent to the nozzle plate has a water-repellency that is different from a water-repellency of the nozzle plate, wherein ink gathers at a boundary between the nozzle plate and the area due to the difference between the water-repellencies;

at least one suction section which includes at least one suction opening having a suction area that is larger than any one of the nozzles, and a negative pressure generating section which applies a negative pressure to the suction area of the suction opening, so as to draw ink present in the suction area by suction to a fluid passage, wherein the suction opening communicates with the fluid passage via an inlet hole through which the ink is drawn;

a suction section driving mechanism which causes the suction opening to face the nozzles, and which moves the suction section with respect to the nozzles along a nozzle arrangement direction along which the nozzles are arranged in the column; and a positive pressure applying section which applies a positive pressure to the ink chamber, wherein when the suction opening faces the nozzles, the inlet hole faces said boundary on the inkjet head; and wherein while the positive pressure applying section applies the positive pressure to the ink chamber, the suction section driving mechanism moves the suction section in the nozzle arrangement direction, thereby causing the inlet hole to draw in by suction ink present in the vicinity of the nozzles.

2. The image recording apparatus according to claim 1, wherein the suction section comprises an additional inlet hole that is located in a position facing the nozzles in the suction opening when the suction opening faces the nozzles, and a diameter of the additional inlet hole is smaller than a diameter of the inlet hole facing said boundary on the inkjet head.

3. The image recording apparatus according to claim 1, wherein the suction section comprises an additional inlet hole, and wherein said additional inlet hole and said inlet hole facing said boundary on the inkjet head are arranged in the suction opening in a direction perpendicular to the nozzle arrangement direction such that any nozzle facing the suction opening is interposed between said inlet hole and said additional inlet hole.

4. The image recording apparatus according to claim 1, wherein the suction opening extends in a direction perpendicular to the nozzle arrangement direction such that the suction opening communicates with outside air when the suction opening faces the nozzles.

5. The image recording apparatus according to claim 4, wherein the suction openings extend to an area beyond the nozzle plate in a direction perpendicular to the nozzle arrangement direction.

6. The image recording apparatus according to claim 1, wherein the suction section comprises a plurality of suction openings arranged in the nozzle arrangement direction.

7. The image recording apparatus according to claim 1, wherein the inkjet head comprises a guide groove extending in the nozzle arrangement direction, the suction section comprises a projecting part which is adapted to be inserted into the guide groove, and when ink is sucked in by the suction section, the projecting part is inserted into the guide groove and the suction section is guided along the guide groove via the projecting part.

8. The image recording apparatus according to claim 1, wherein the suction section comprises a wiper which wipes ink on the inkjet head.

9. The image recording apparatus according to claim 1, wherein when in a standby state, the suction section is positioned in a region which is located along the nozzle arrangement direction and in which the nozzles are not provided.

10. An image recording apparatus comprising:

an inkjet head which includes a nozzle plate where a plurality of nozzles that shoot ink are arranged in a column, and an ink chamber which retains ink and communicates with the plurality of nozzles;

a suction section which includes: (i) a suction opening which extends in a direction perpendicular to a nozzle arrangement direction along which the nozzles are arranged in the column, and which has a width along the perpendicular direction that is greater than a width in the perpendicular direction of the nozzle plate, and (ii) a negative pressure generating section which makes an inner pressure of the suction opening negative so as to suck ink deposited on a surface of the nozzle plate;

a suction section driving mechanism which causes the suction opening to face the nozzles, and which moves the suction section in the nozzle arrangement direction; and a positive pressure applying section which applies a positive pressure to the ink chamber, wherein while the positive pressure applying section applies the positive pressure to the ink chamber, the suction section driving mechanism moves the suction section in the nozzle arrangement direction, thereby causing the suction section to suck the ink deposited on the surface of the nozzle plate.

11. The image recording apparatus according to claim 10, wherein:

the suction opening of the suction section defines a suction area, and the negative pressure generating section of the suction section applies the negative pressure to the suction opening so as to draw in by suction ink present in the suction area; and the suction section includes a fluid passage to receive the ink drawn in by suction, the negative pressure generating section is connected to the suction opening via the fluid passage, and an inlet hole which communicates with the fluid passage is provided in a position in the suction opening to face an area other than the nozzles of the ink jet head when the suction section draws in ink by suction.

12. The image recording apparatus according to claim 11, wherein the suction section comprises an additional inlet hole that is located in a position facing the nozzles in the suction opening when the suction opening faces the nozzles, and a diameter of the additional inlet hole is smaller than a diameter of the inlet hole facing the area other than the nozzles.

13. The image recording apparatus according to claim 11, wherein:

an area of the inkjet head that is positioned adjacent to the nozzle plate has a water-repellency that is different from a water-repellency of the nozzle plate, wherein ink gathers at a boundary between the nozzle plate and the area due to the difference between the water repellencies; and the inlet hole faces said boundary.

14. The image recording apparatus according to claim 11, wherein the suction section comprises an additional inlet hole, and wherein said additional inlet hole and said inlet hole facing said area other than the nozzles are arranged in the suction opening in the direction perpendicular to the nozzle arrangement direction such that any nozzle facing the suction opening is interposed between said inlet hole and said additional inlet hole.

15. The image recording apparatus according to claim 10, wherein when in a standby state, the suction section is positioned in a region which is located along the nozzle arrangement direction and in which the nozzles are not provided.

16. The image recording apparatus according to claim 10, wherein the suction section comprises a plurality of suction openings arranged in the nozzle arrangement direction.

17. The image recording apparatus according to claim 10, wherein the inkjet head comprises a guide groove extending in the nozzle arrangement direction, the suction section comprises a projecting part which is adapted to be inserted into the guide groove, and when ink is sucked in by the suction section, the projecting part is inserted into the guide groove and the suction section is guided along the guide groove via the projecting part.

18. The image recording apparatus according to claim 10, wherein the suction section comprises a wiper which wipes ink on the inkjet head.

19. An image recording apparatus comprising:

an inkjet head which includes a nozzle plate where a plurality of nozzles that shoot ink are arranged in a column, and an ink chamber which retains ink and communicates with the plurality of nozzles; and at least one suction section which includes a suction opening extending in a direction perpendicular to a nozzle arrangement direction along which the nozzles are arranged in the column, and a negative pressure generating section which makes an inner pressure of the suction opening negative so as to draw in by suction at least ink present on the nozzles through an inlet hole provided in the suction opening;

wherein the suction opening has first and second ends in the direction perpendicular to the nozzle arrangement direction, wherein at the first end an air-intake inlet is provided, which extends beyond the nozzle plate in the direction perpendicular to the nozzle arrangement direction and takes in air to cause the air to flow toward the suction opening, and the inlet hole is provided at the second end; and wherein the suction section is caused to face the nozzles to perform a suction operation, to draw in by suction at least the ink present on the nozzles, whereby air outside of the suction opening is taken in the suction opening at the first end to flow toward the second end, and at least the ink on the nozzle plate is drawn by suction in the inlet hole due to the air flowing toward the second end.

20. An image recording apparatus comprising:

an inkjet head which includes a nozzle plate where a plurality of nozzles that shoot ink are arranged in a column, and an ink chamber which retains ink and communicates with the plurality of nozzles;

a cover which covers an outer periphery of the nozzle plate;

a suction section which includes: (i) a suction opening which extends in a direction perpendicular to a nozzle arrangement direction along which the nozzles are arranged in the column, and which has a width along the perpendicular direction that is greater than a width in the perpendicular direction of a portion of the nozzle plate that is exposed from the cover, and (ii) a negative pressure generating section which makes an inner pressure of the suction opening negative so as to suck ink deposited on a surface of the portion of the nozzle plate exposed from the cover;

a suction section driving mechanism which causes the suction opening to face the nozzles, and which moves the suction section in the nozzle arrangement direction; and a positive pressure applying section which applies a positive pressure to the ink chamber, wherein while the positive pressure applying section applies the positive pressure to the ink chamber, the suction section driving mechanism moves the suction section in the nozzle arrangement direction, thereby causing the suction section to suck the ink deposited on the surface of the portion of the nozzle plate exposed from the cover.

21. An image recording apparatus comprising:

an inkjet head which includes a nozzle plate where a plurality of nozzles that shoot ink are arranged in a column, and an ink chamber which retains ink and communicates with the plurality of nozzles; and at least one suction section which includes a suction opening which extends in a direction perpendicular to a nozzle arrangement direction along which the nozzles are arranged in the column, an intake opening through which air is taken in the suction opening from outside the suction opening, and a negative pressure generating section which sucks ink present on at least the nozzle plate through an inlet hole provided in the suction opening, wherein the inlet hole is provided at a position which is displaced from the plurality of nozzles and which is opposite to the intake opening about a position where the plurality of nozzles are arranged in the column, and the air taken in through the intake opening flows toward the inlet hole in a direction perpendicular to a direction in which the ink is shot from the nozzles.

22. The image recording apparatus according to claim 21, wherein the intake opening and the inlet hole are provided at opposite ends of the suction opening in the direction perpendicular to the nozzle arrangement direction.

* * * * *